US010920415B2

(12) United States Patent
Jones et al.

(10) Patent No.: US 10,920,415 B2
(45) Date of Patent: Feb. 16, 2021

(54) BUILDING SYSTEMS, PANEL SYSTEMS, AND FORMWORK SYSTEMS, PANELS AND FORMWORK FOR BUILDING AND METHODS OF BUILDING USING PANELS AND FORMWORK

(71) Applicant: Fast Build Systems Pty Ltd, Newcastle (AU)

(72) Inventors: Alan Stephen Jones, Newcastle (AU); Paul George DeOliveira, Newcastle (AU)

(73) Assignee: Fast Build Systems Pty Ltd, Newcastle (AU)

( * ) Notice: Subject to any disclaimer, the term of this patent is extended or adjusted under 35 U.S.C. 154(b) by 0 days.

(21) Appl. No.: 16/305,335

(22) PCT Filed: May 29, 2017

(86) PCT No.: PCT/AU2017/050506
§ 371 (c)(1),
(2) Date: Nov. 28, 2018

(87) PCT Pub. No.: WO2017/205910
PCT Pub. Date: Dec. 7, 2017

(65) Prior Publication Data

US 2019/0277023 A1 Sep. 12, 2019

(30) Foreign Application Priority Data

May 31, 2016 (AU) ..... 2016902067

(51) Int. Cl.
*E04B 1/38* (2006.01)
*E04B 1/24* (2006.01)
(Continued)

(52) U.S. Cl.
CPC ..... *E04B 1/6806* (2013.01); *E02D 27/02* (2013.01); *E04B 1/043* (2013.01); *E04B 1/24* (2013.01);
(Continued)

(58) Field of Classification Search
CPC ..... E04B 1/34321; E04B 1/38; E04B 2/00; E04B 1/40; E04B 1/6806; E04B 1/24;
(Continued)

(56) References Cited

U.S. PATENT DOCUMENTS 2,099,077 A * 11/1937 Pessagno ..... E04G 9/06 249/27
2,937,065 A 5/1960 Harza et al.
(Continued)

FOREIGN PATENT DOCUMENTS

| | | |
|---|---|---|
| CA | 980095 | 12/1975 |
| GB | 436584 | 10/1935 |
| JP | 2011137343 | 7/2011 |

OTHER PUBLICATIONS

Written Opinion and International Search Report of PCT/AU2017/050506 dated Sep. 11, 2017, 18 pages.

*Primary Examiner* — Phi Dieu Tran A
(74) *Attorney, Agent, or Firm* — Rankin, Hill & Clark LLP

(57) ABSTRACT

A building system (5) including a panel system (10) and a formwork system (78). The panel system (10) includes a plurality of modular panels (12) arranged to fit with one another in a predetermined grid arrangement (13) to form side walls of a building in a fitted condition. At least the bottom sides (24) of each of the modular panels (12) includes a plurality of apertures (34) that are arranged at predetermined spaced apart locations along the bottom side (24) so as to coincide with the predetermined grid arrangement (13). The formwork system (78) includes a plurality of
(Continued)

modular formwork members (80) that are associated with each of the modular panels (12) to provide a supporting slab (72) having slab apertures (76) to allow coupling with the modular panels (12). Modular panels (12), formwork members (80) and associated methods of use are also disclosed.

16 Claims, 24 Drawing Sheets

(51) Int. Cl.

| | |
|---|---|
| ***E04G 11/08*** | (2006.01) |
| ***E04B 1/68*** | (2006.01) |
| ***E02D 27/02*** | (2006.01) |
| ***E04B 1/04*** | (2006.01) |
| ***E04C 2/38*** | (2006.01) |
| ***E04G 11/50*** | (2006.01) |
| ***E04G 15/06*** | (2006.01) |
| ***E04G 17/04*** | (2006.01) |

(52) U.S. Cl.
CPC ..... *E04C 2/384* (2013.01); *E04G 11/08* (2013.01); *E04G 11/50* (2013.01); *E04G 15/06* (2013.01); *E04G 17/04* (2013.01); *E04B 2001/2412* (2013.01); *E04B 2001/2421* (2013.01); *E04B 2001/2451* (2013.01)

(58) Field of Classification Search
CPC ..... E04B 2001/2421; E04B 2001/2451; E04B 1/043; E04B 2001/2412; E02D 27/02; E04C 2/384; E04G 11/08; E04G 11/50; E04G 15/06; E04G 17/04
See application file for complete search history.

(56) References Cited

U.S. PATENT DOCUMENTS

| | | | | |
|---|---|---|---|---|
| 3,113,401 | A * | 12/1963 | Jessup | E04B 1/54 52/417 |
| 3,330,084 | A * | 7/1967 | Russell | E04B 1/043 52/300 |
| 3,452,498 | A * | 7/1969 | Kinsey | E04B 1/0007 52/262 |
| 4,231,199 | A | 11/1980 | Gomez et al. | |
| 4,676,038 | A * | 6/1987 | Doyon | A47B 47/0041 403/231 |
| 4,813,193 | A * | 3/1989 | Altizer | E04B 1/14 52/210 |
| 5,509,242 | A * | 4/1996 | Rechsteiner | E04B 1/14 52/220.2 |
| 6,367,215 | B1 * | 4/2002 | Laing | E02D 27/16 52/157 |
| 7,124,545 | B1 * | 10/2006 | Poma | E04B 1/04 52/293.3 |
| 7,493,731 | B2 * | 2/2009 | Zhang | G09B 25/04 52/250 |
| 7,984,594 | B1 * | 7/2011 | Propst | B32B 3/18 52/309.12 |
| 8,156,690 | B2 * | 4/2012 | Higley | E04B 1/34321 52/169.5 |
| 8,769,908 | B1 | 7/2014 | Santini | |
| 9,151,053 | B2 * | 10/2015 | Stephens, Jr. | E04C 2/521 |
| 9,399,867 | B2 * | 7/2016 | Di Lorenzo | E04B 1/043 |
| 2002/0069600 | A1 * | 6/2002 | Bryant | E04B 1/12 52/309.9 |
| 2004/0103601 | A1 * | 6/2004 | Bergqvist | E02D 5/801 52/284 |
| 2010/0115867 | A1 * | 5/2010 | Bui | E04B 2/707 52/284 |

* cited by examiner

BUILDING SYSTEMS, PANEL SYSTEMS, AND FORMWORK SYSTEMS, PANELS AND FORMWORK FOR BUILDING AND METHODS OF BUILDING USING PANELS AND FORMWORK

RELATED APPLICATIONS

This application claims priority from Australian provisional patent application no. 2016902067 filed on 31 May 2016, the contents of which are incorporated by reference.

TECHNICAL FIELD

The invention relates to a improvements in building systems, including a panel system, seals and coupling between panels, a slab forming system for building panels, a coupling for formwork members, and related methods including methods for fitting building panels to a building slab or foundation, methods for coupling formwork members, and methods for forming a slab using formwork members.

BACKGROUND

Building systems including modular wall panels are utilised in building to reduce costs and time during construction. Many types of building systems including modular wall panels are available and may be constructed from a cement composite material or a sandwich composite material including a polystyrene core sandwiched between Gypsum sheets. These panels may be available in a limited range of sizes and some may include pre-formed cut-outs for windows and doors.

In use, the modular wall panels are typically stood on a supporting ground surface and interconnected side-by-side by connector such as integral tongue and groove connectors carried by adjacent panels.

A problem with existing building systems relates to the modularity of the system such as number and configuration of panels and how these panels are connected or supported by a base such as a concrete slab. A more specific problem relates to a repeatable, robust and weather proof fit between the panels and, in particular, between panels and the concrete slab.

Another problem with existing modular wall panels relates to the adaptability of the panels to provide a suitable wall, such as a veneer wall, for a typically building structure such as a metal or timber framed house. Yet another problem relates to the ease and accuracy in which existing modular wall panels may be fitted with one another and with a supporting ground or base structure. Yet another problem with existing modular wall panels relates to the sealing between the panels and the supporting ground or base structure. Yet another problem with existing modular wall panels relates to the forming of a suitable ground or base structure to fit with and support the modular wall panels. Yet another problem with existing modular wall panels is the suitability for providing structural support.

Concrete slabs are typically formed with formwork. Traditionally such formwork includes an outer formwork member that defines an outer perimeter and a rebate formwork member that sits inside a top edge of the outer formwork member to define a rebate on which the building frame or bricks may be supported. The outer formwork member and the rebate formwork member are typically formed from wood and are cut to length for each new slab. The formwork members may be abutted against one another to increase length and jointed at a mitre joint at the corners thereof.

A problem with such formwork relates to repeatability, accuracy and joining of the formwork members that results in poor accuracy and repeatability of the formation of the rebate of the slab. Another problem is that such formwork may provide difficult for use with pre-formed modular panels due to misalignment between the formed rebate and the panels that result in issues with the accuracy repeatability, and suitability of fit between the resulting slab and modular panels.

The invention disclosed herein seeks to overcome one or more of the above identified problems or at least provide a useful alternative.

SUMMARY

In accordance with a first broad aspect there is provided, a panel system including a plurality of modular panels arranged to fit with one another. The fit may be in a predetermined grid arrangement to form coextensive sidewalls of a building in a fitted condition. The modular panels may each include opposing sides, a bottom side and a topside. At least the bottom sides of each of the modular panels may include a plurality of apertures that are arranged at predetermined spaced apart locations along the bottom side. The predetermined spaced apart locations may coincide with the predetermined grid arrangement.

In an aspect, the topside includes a further plurality of apertures at spaced apart locations along the topside so as to coincide with the predetermined grid arrangement.

In another aspect, each of the modular panels each include a front side and an opposing backside, the backside having a rebated portion skirted by a frame, wherein the frame includes an inner side oriented toward the rebated portion and an opposing outer side, and wherein the plurality of apertures are arranged to pass between the inner side and outer side of the frame.

In yet another aspect, the outer side of the frame includes a sealing arrangement located toward the front side of the frame relative to the plurality of apertures.

In yet another aspect, the sealing arrangement includes a seal extending along each of the sides of the frame such that corresponding seals of adjacently arranged ones of the plurality of panels sealingly engage with one another in the fitted condition.

In yet another aspect, the outside of the frame includes a channel in which the plurality of apertures are located.

In yet another aspect, the bottom sides of each of the plurality of modular panels include a drain passage extending between the rebated portion and the outside of the bottom side of the frame.

In yet another aspect, the system further includes a plurality of fasteners arranged to pass between corresponding ones of the plurality of modular panels to secure adjacently arranged ones of the plurality of modular panels together in the fitted condition.

In accordance with a second broad aspect there is provided, a formwork system for a modular panel system as defined in any one of the previous claims, the formwork system including a plurality of modular formwork members that correspond to the plurality of the modular panels.

In an aspect, the plurality of modular formwork members each include a body adapted to form a rebate into a cast slab, the rebate being shaped to fit with the bottom side of a corresponding one of the plurality of modular panels in the fitted condition.

In another aspect, the body is adapted to carry a seal that is released by the body so as to be retained by the slab in a cured condition when the body is removed.

In yet another aspect, the releasable seal includes a head releasably retained by a retaining channel of the body and an anchor stem extending from the head, the anchor stem being embedded into the slab in the cured condition.

In yet another aspect, in the cured condition, the seal is arranged to sealing engage with corresponding seals carried by corresponding ones of the plurality of panels.

In yet another aspect, in the body is adapted to carry void formers that are arranged to form slab apertures that are aligned with at least some of the plurality of apertures of the corresponding plurality of modular panels.

In yet another aspect, the body includes a bottom side, a top side, an inner side and an outer side, the bottom side including a channel to initially carry the seal and a plurality of apertures, the channel extending lengthwise along the body and the plurality of apertures being located in a spaced apart lengthwise arrangement between the channel and the inner side.

In yet another aspect, the bottom side includes a lengthwise rib extending from the bottom side and wherein the plurality of apertures are located at spaced apart intervals along the lengthwise rib.

In yet another aspect, the top side includes a plurality of apertures that align with the plurality of apertures of the bottom side to allow a void former to be inserted therethrough so as to form voids that align with apertures of panels of the panel system.

In yet another aspect, the void formers include inserts that are cast into the slab in the cured condition, the inserts including a passage that provides the slab apertures.

In yet another aspect, the body of each of the formwork members is provided in the form of a hollow section.

In yet another aspect, the body of each of the formwork members is provided in the form of hollow sections that are adapted to couple with one another via a coupling.

In yet another aspect, one of the couplings includes a tongue having an tongue aperture and the other of the couplings includes flanking members that define a recess into which the tongue is received in the coupled condition.

In yet another aspect, the flanking members including a tapered entry aperture located in the coupled condition on one side of the tongue and a threaded aperture located in the coupled condition at an opposing side of the tongue that align with one another and the tongue aperture in the coupled condition such that a tapered portion of the fastener that is engagable with the tapered entry aperture is passed through the tongue aperture with a threaded end of the fastener being coupled to the threaded aperture thereby drawing the at least two formwork members into abutting alignment with one another.

In yet another aspect, the coupling is provided in the form of a male side and a female side that are provided at the ends of the respective ones of the bodies.

In yet another aspect, the male side includes a tongue that is received by a recess of the female side, the male and female sides including corresponding apertures that form a passage through which a fastener is fitted to secure the male and female sides together.

In yet another aspect, the passage and fastener are inwardly tapered between an entry end and an opposing end of the passage such that movement of the fastener between the entry end and the opposing end draws the male and female sides into aligned abutment.

In accordance with a third broad aspect there is provided, a building system as described above and herein.

In accordance with a fourth broad aspect there is provided, a panel for forming a wall, the panel including opposing sides, a bottom side a topside, a front side and an opposing backside, the backside being at least partially skirted by rib, the rib including an inner side face oriented toward the rebated portion and an opposing outer side face, wherein a plurality of apertures are arranged to pass between the inner side and outer side of the frame.

In an aspect, the outer side of the frame includes sealing arrangement located toward the front side of the frame relative to the plurality of apertures.

In another aspect, the rebated portion substantially spans the backside between the frame.

In accordance with a fifth broad aspect there is provided, a panel system including a plurality of panels as described above and herein, wherein the plurality of apertures of each of the plurality of panels are arranged to be aligned with one another in a fitted condition so as to allow a fastener to be passed there between.

In accordance with a sixth broad aspect there is provided, a formwork system for use with a panel system as described above, wherein the formwork system includes a plurality of formwork members that are each associated with one of the plurality of panels.

In accordance with a seventh broad aspect there is provided, a formwork system as described above and herein, wherein the plurality of formwork members each carry at least one of a releasable seal and a void forming insert that are cast into a slab in a cured condition so as to fit with corresponding ones of the plurality of panels in the fitted condition.

In accordance with an eighth broad aspect there is provided, a formwork system including at least two formwork members and a fastener, each of the form work members including corresponding couplings at opposing ends thereof that are fitted together in a coupled condition, wherein one of the couplings includes a tongue having an tapered tongue aperture and the other of the couplings includes flanking members that define a recess into which the tongue is received in the coupled condition, the flanking members including a tapered entry aperture located in the coupled condition on one side of the tongue and a threaded aperture located in the coupled condition at an opposing side of the tongue that align with one another and the tongue aperture in the coupled condition such that a tapered portion of the fastener that is engagable with the tapered entry aperture is passed through the tapered tongue aperture with a threaded end of the fastener being coupled to the threaded aperture thereby being actuable to draw the at least two formwork members into abutting alignment with one another.

In an aspect, the tongue and flanking members are set back relative to at least one opposing side and bottom side of the formwork members to define side abutment edges of the at least one opposing side and bottom side such that in the coupled condition the side abutment edges of the at the least one opposing side and bottom side of the adjacently coupled formwork members are abutted and outwardly oriented faces of least one opposing side and bottom side are generally flush with one another.

In accordance with an ninth broad aspect there is provided, a formwork member for forming a rebate in a concrete slab, the formwork member including an elongate body having opposing ends, a top side, a bottom side, an inner side and an outer side, wherein the bottom side includes a lengthwise channel arranged to releasably carry a head of a seal such that in use a stem of the seal is castable into the rebate and the formwork is removeable to expose the head of the seal so as to extend lengthwise along the rebate.

In an aspect, the bottom side includes a plurality of spaced apart apertures that extend parallel to the seal and are located toward the inner side relative to the seal.

In accordance with tenth broad aspect there is provided, a method of building using a panel system and an associated formwork system, the method may in some aspects include the steps of: selecting a plurality of panels of the panel system; selecting an plurality of formwork members of the formwork system that are associated with each of the plurality of panels; locating the plurality of formwork members such that a slab having a rebate is formable about the formwork members, the slab being formed with a least one slab aperture in the rebate associated with each of the formwork members; removing the plurality of formwork members from the slab in the cured condition, and locating the plurality of panels atop the rebate of the slabs, the plurality of panels being located in place of the removed associated formwork member; and fitting a fastener between an aperture of a bottom side of the plurality of panels and the associated slab aperture thereby coupling the plurality of panels to the slab.

In accordance with an eleventh broad aspect there is provided method of building using a panel system and an associated formwork system, the method including the steps of: locating a formwork member of the formwork system that carries a lengthwise seal such that a slab having a rebate is formed with the formwork member so as to have an exposed stem of the seal embedded in the rebate and a slab aperture extending into the rebate; removing the formwork member from the slab in a cured condition such that the seal is released from the formwork member and retained by the rebate; locating a panel of the panel system atop the rebate of the slab with a seal carried by the panel abutting with the seal of the rebate and aligning an aperture of the panel with the a slab aperture; and fitting a fastener between the aperture of the panel and the slab aperture thereby coupling the panel to the slab.

In accordance with an twelfth broad aspect there is provided, a method of building a supported wall using a panel and a formwork system, the method including: forming a concrete slab with a formwork member of the formwork system so as to have a rebate and an aperture extending depth wise into the rebate formed by a void former of the formwork system; locating the panel atop the rebate with an aperture of the panel being aligned with the aperture of the rebate; and coupling the panel to the slab via a fastener passed between the aperture of the panel and the aperture of the rebate so as to provide the supported wall.

In accordance with an thirteenth broad aspect there is provided, a method of building a supported wall using a panel and a formwork system, the method including: forming a concrete slab about a formwork member of the formwork system so as to have a rebate, a lengthwise seal carried by the formwork member, and an aperture extending depth wise into rebate formed by a void former of the formwork system; removing the formwork member from the slab in a cured condition such that the seal is released from the formwork member and retained by the rebate; locating a panel of the panel system atop the rebate of the slab with a seal carried by the panel abutting with the seal of the rebate and aligning an aperture of the panel with the slab aperture; and securing a fastener through the aperture of the panel into the slab aperture thereby coupling the panel to the slab in an upright orientation.

In accordance with an fourteenth broad aspect there is provided, a method of preparing a concrete slab for sealing with a wall panel supported by the slab, the method including: locating a formwork member that carries a lengthwise seal such that a slab having a rebate is formed along the formwork member, the slab having an exposed stem of the seal embedded therein and a slab aperture extending vertically downwardly into the rebate, and removing the formwork member from the slab in a cured condition such that the seal is released from the formwork member and is retained along the rebate by the cured concrete, the position of the seal being suitable to be abutted with a corresponding seal of the wall panel seatable thereon in an installed condition in which a fastener couples the wall panel to the rebate via the slab aperture.

BRIEF DESCRIPTION OF THE FIGURES

The invention is described, by way of non-limiting example only, by reference to the accompanying figures, in which.

DETAILED DESCRIPTION

Figure 1:
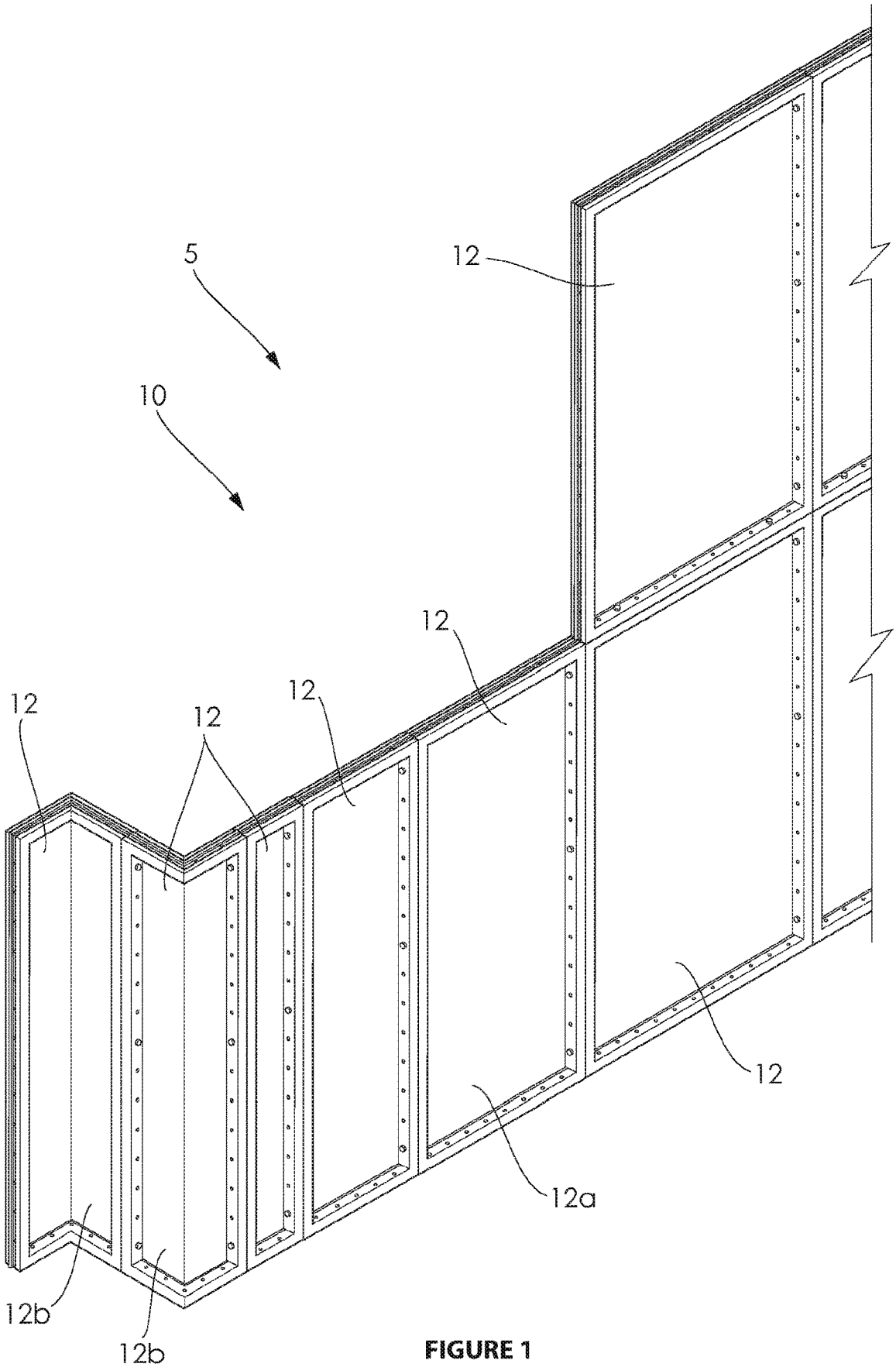
FIG. 1 perspective view illustrating a panel system including a plurality of panels in coupled condition so as to form a free-standing wall.

Referring to FIG. 1, there is shown a building system 5 including a panel system 10 for forming walls of a building or the like. The panel system 10 including a plurality of modular panels 12 arranged to fit and couple with one in either a side-by-side or end-on end (or stacked) arrangement to form side walls of the building in a fitted condition such as that shown in FIG. 1.

The modular panels 12 include a variety of panel sizes and shapes and may be generally flat rectangular panels, such as panels 12*a* as shown in FIG. 1, or angled corner panels as panels 12*b*, as shown in FIG. 1. The types and configurations of the panels 12 are further described below with reference to FIGS. 3*a* and 3*b*.

Figure 2:
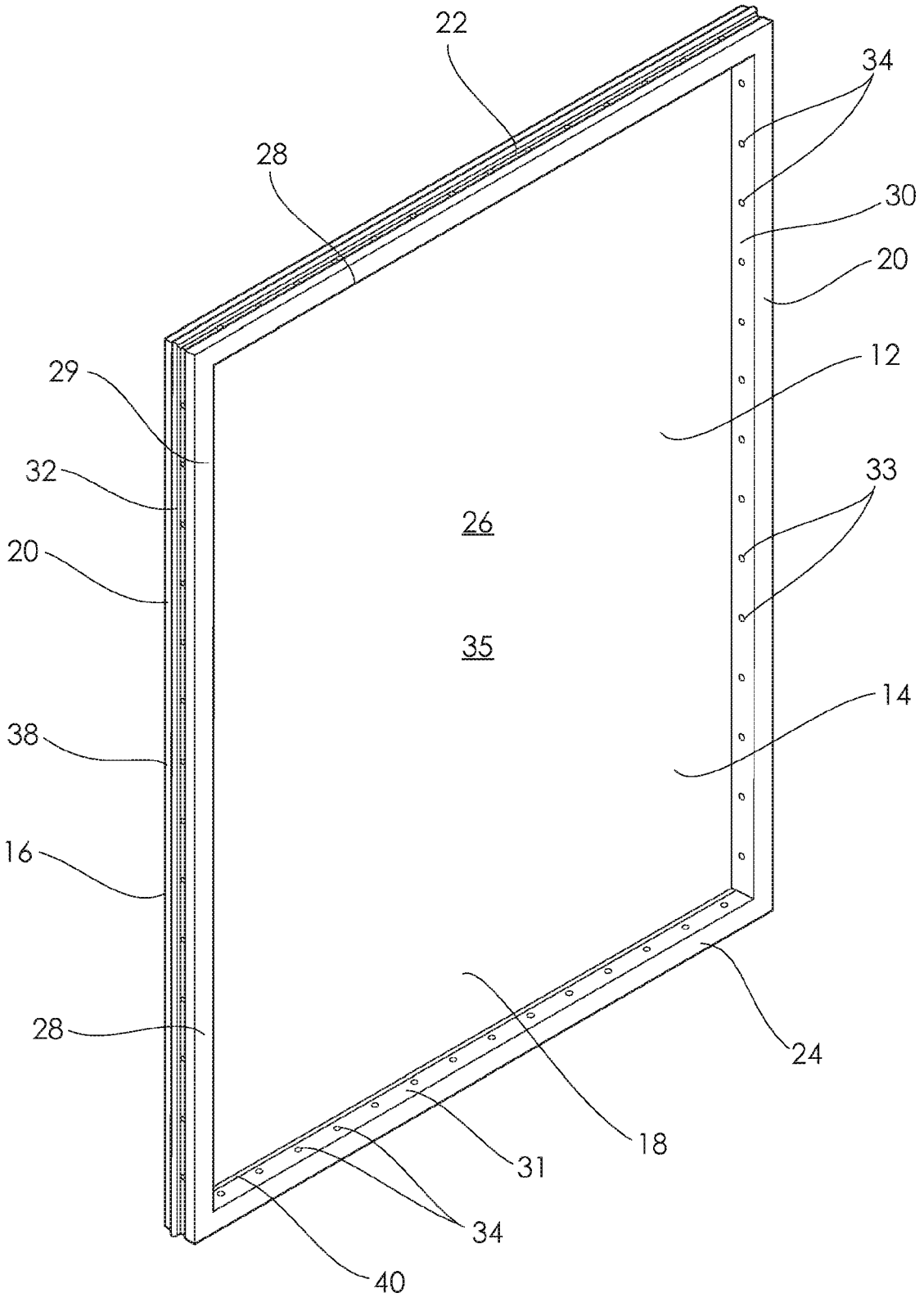
FIG. 2 is a perspective view illustrating a exemplary example of a panel of the panel system.

Referring to FIG. 2, each of the panels 12 includes a panel body 14 having a front side 16, an opposing rear or backside 18, opposing sides 20, a topside 22 and a bottom or base side 24. The backside 18 includes a rectangular rebated portion 26 skirted by a frame 28. The frame 28 provides the opposing sides 20, the topside 22 and the bottom side 24.

The frame 28 is provided in the form of a skirting rib 29 that stands proud of the rebated portion 26 and includes an inner side 30 oriented toward the rebated portion 26 and an opposing outer side 32 that forms an outer perimeter of the panel 12. The inner side 30 and outside 32 are both about perpendicular to a face 35 of the rebated portion 26.

The panels 12 include a plurality of apertures 34 that are arranged in predetermined spaced apart intervals along each of the opposing sides 20, the top side 22 and the bottom side 24. More specifically, the plurality of apertures 34 include a plurality of horizontally spaced apart apertures 31 along each of the top side 22 and the bottom side 24, and a plurality of vertically spaced apart apertures 33 along each of the opposing sides 20.

The plurality of apertures 34 are arranged to pass through the frame 28 between the inner side 30 of the frame 28 and the outer side 32 of the frame 28. This allows fasteners 36 passed through the apertures 34 to be accessible from the inner side 30 of the frame 28 at least partially within the rebated portion 26. The fasteners 36 may be metal bolts or other suitable plastic fasteners.

The outer side 32 of the frame 28 includes a sealing arrangement 38 located toward the front side 16 of the panel 12 relative to the plurality of apertures 34. The front side 16 is typically oriented toward the external environment and as such the sealing arrangement 38 is positioned to seal the plurality of apertures 34 from the external environment. Further details of the sealing arrangement 38 of the outer side 32 of the frame 28 are provided below with reference to FIGS. 4 to 7. The bottom side 24 of the panel 12 includes a drainage arrangement 40 that is further described below with reference to FIG. 10.

Figure 3A:
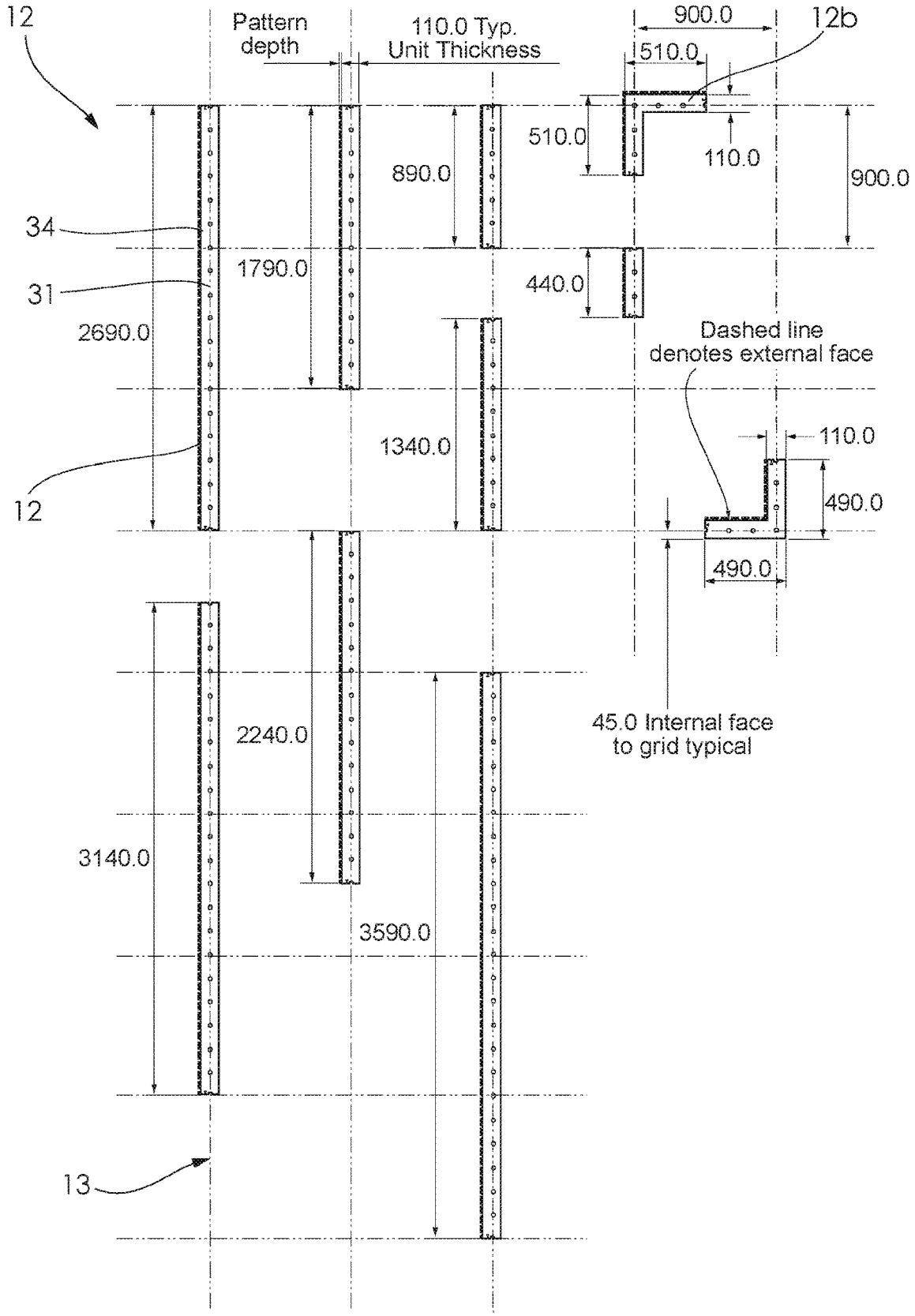
FIG. 3*a* is top view illustrating a series of the panels having a variety of sizes to fit with first pre-determined grid.
Figure 3B:
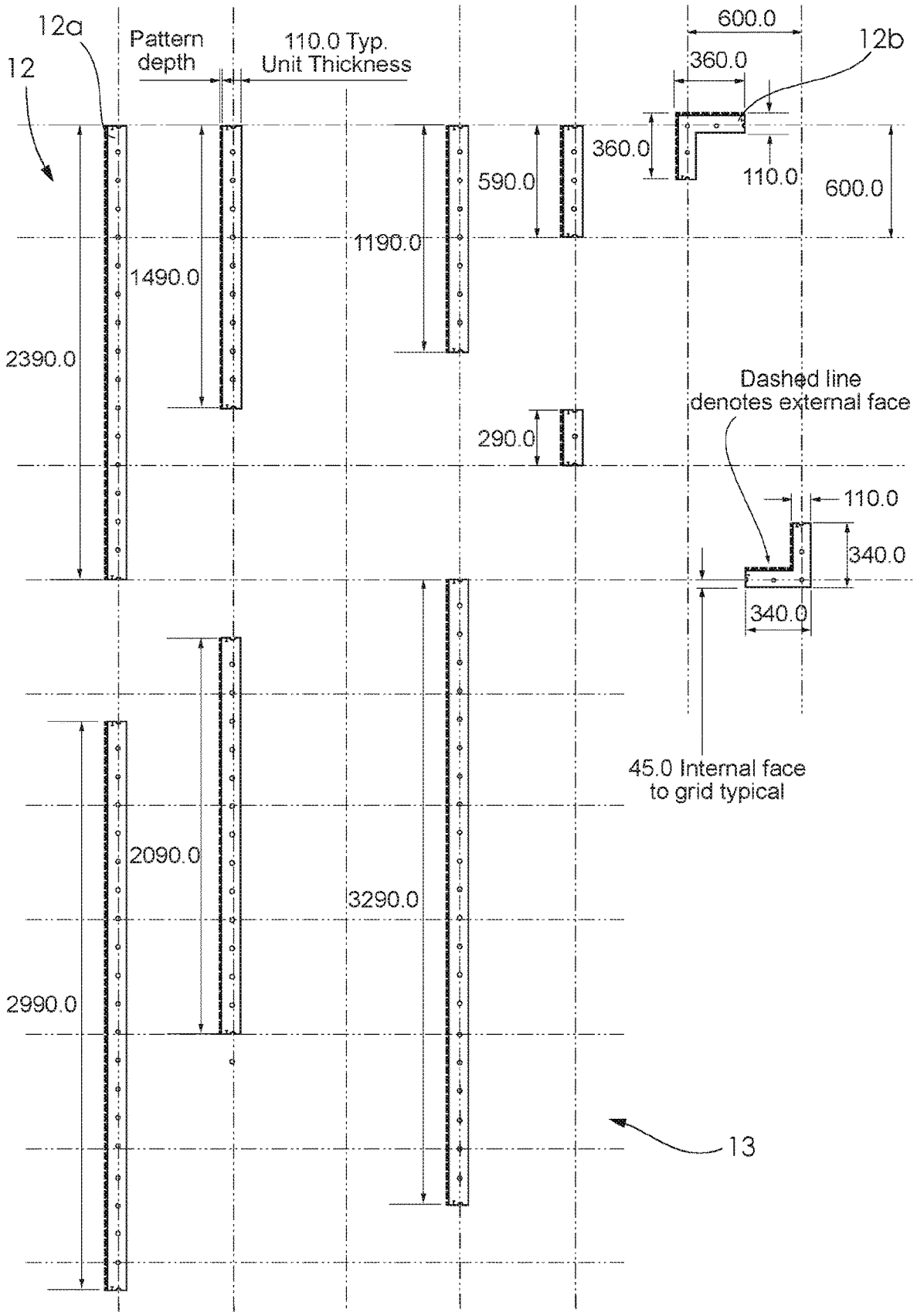
FIG. 3*b* is top view illustrating a series of the panels having a variety of sizes to fit with a second pre-determined grid.
Figure 4:
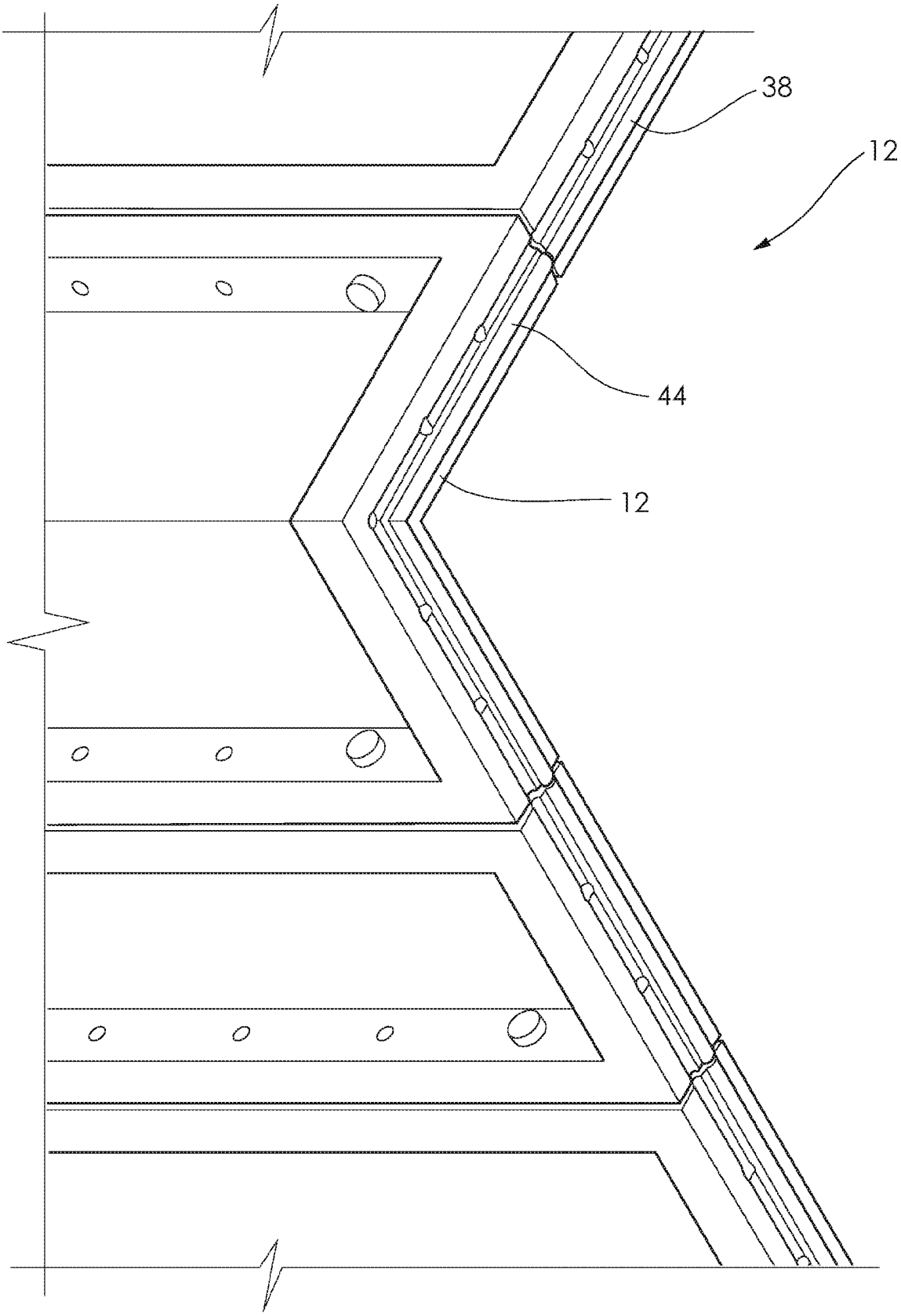
FIG. 4 is a perspective top view illustrating panels of the panel system in a fitted condition.
Figure 5:
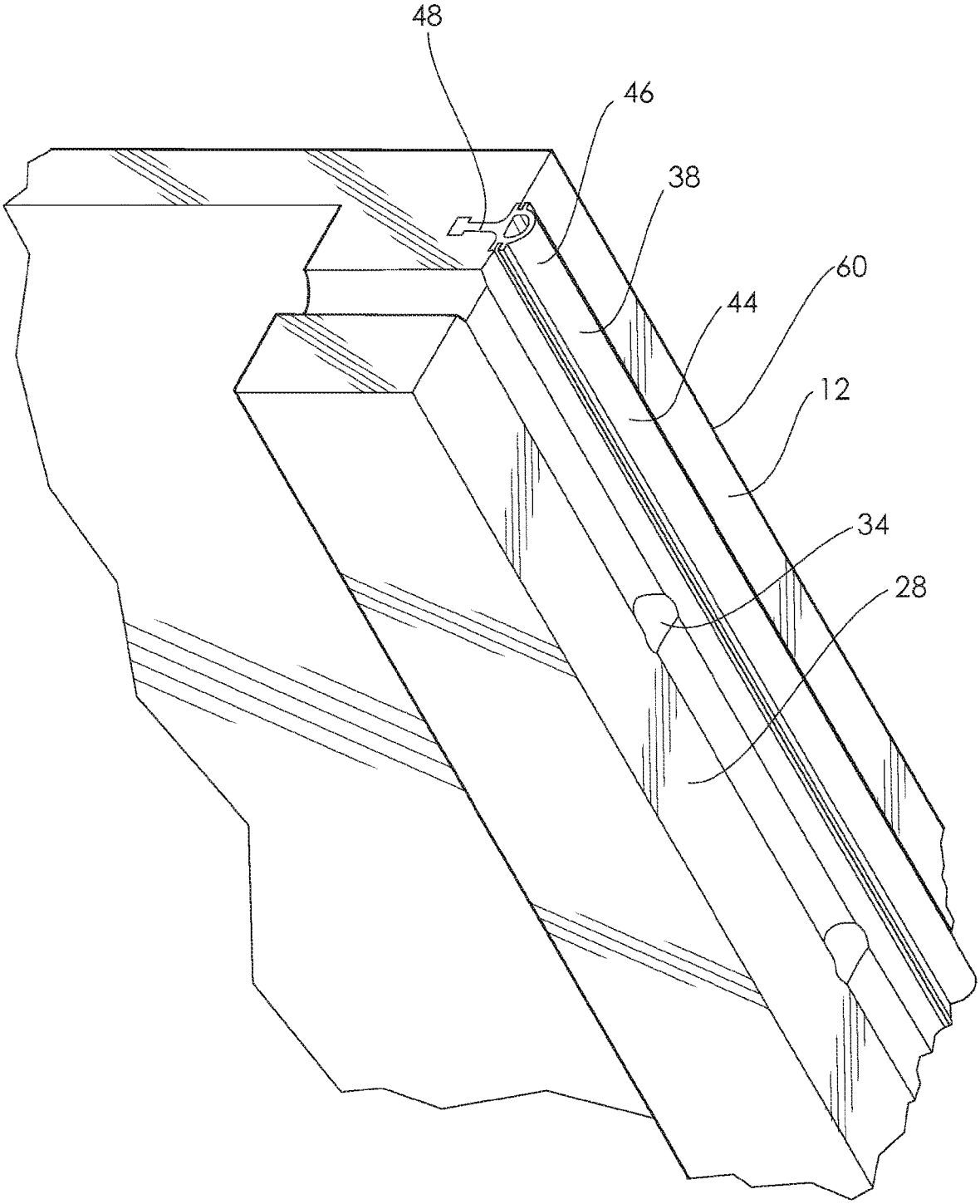
FIG. 5 is a cutaway top perspective view illustrating an outer side of a frame of the panel.

Referring now to FIGS. 3*a* and 3*b*, modular panels 12 may be provided in a series of predetermined sizes including straight panels 12*a* and angled or corner panels 12*b*. The modular panels 12 and preferably adapted to fit with a predetermined grid 13 and each of the plurality of apertures 34, at least on the base 24, is arranged and a predetermined spacing to fit with the predetermined grid 13.

In this example, the predetermined spacing between horizontal apertures 31 of the plurality of apertures 34 is 150 mm and the predetermined grid may be a 900 mm grid as shown in FIG. 3*a* or a 600 mm grid as shown in FIG. 3*b*. The predetermined spacing between the vertical apertures 33 may be the same or different to the spacing between the horizontal apertures 31, and in this example, the spacing between the vertical apertures 33 may be about 200 mm. The vertical aperture 33 allow for step down between adjacently coupled panels 12.

Each of the sets of panels 12 associated with the 600 mm grid or the 900 mm grid are provided in approximately ten lengths and all sizes that may into fit with one another to provide most building shapes. A range of suitable dimensions is indicated on FIGS. 3*a* and 3*b*. It is also noted that the overall width of the panels 12 is preferably 110 mm which is the thickness of a common brick wall and as such the panels adapt well to existing building dimensions and construction practices. It is noted that the width of the skirting rib 29 may be about 70 mm and the depth of the rebated portion 26, and hence the depth inside 30 of the frame 28 is about 85 mm. However, other suitable dimensions may be used.

Figure 6:
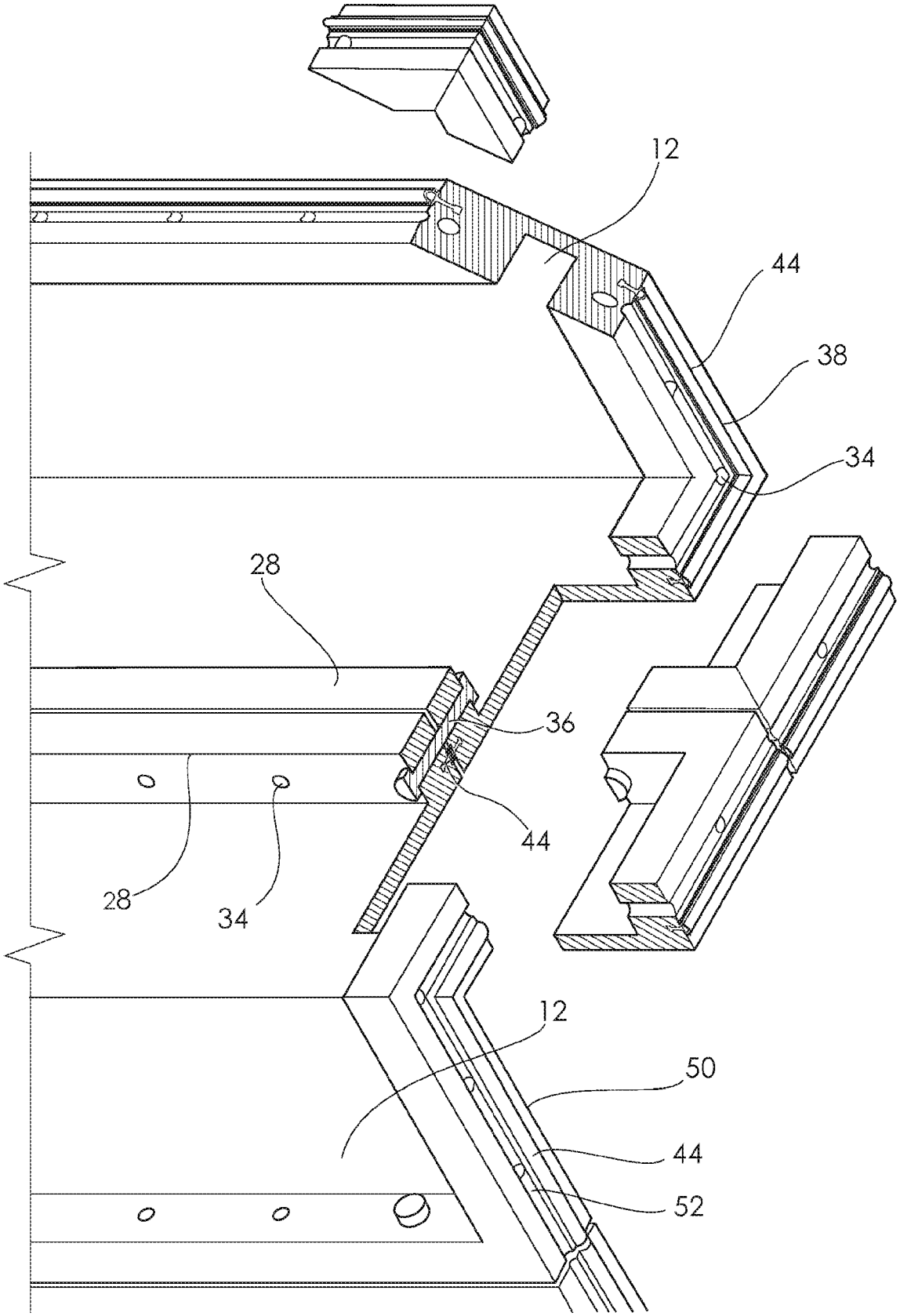
FIG. 6 is a partial cutaway top perspective view illustrating coupling between adjacent panels.
Figure 7:
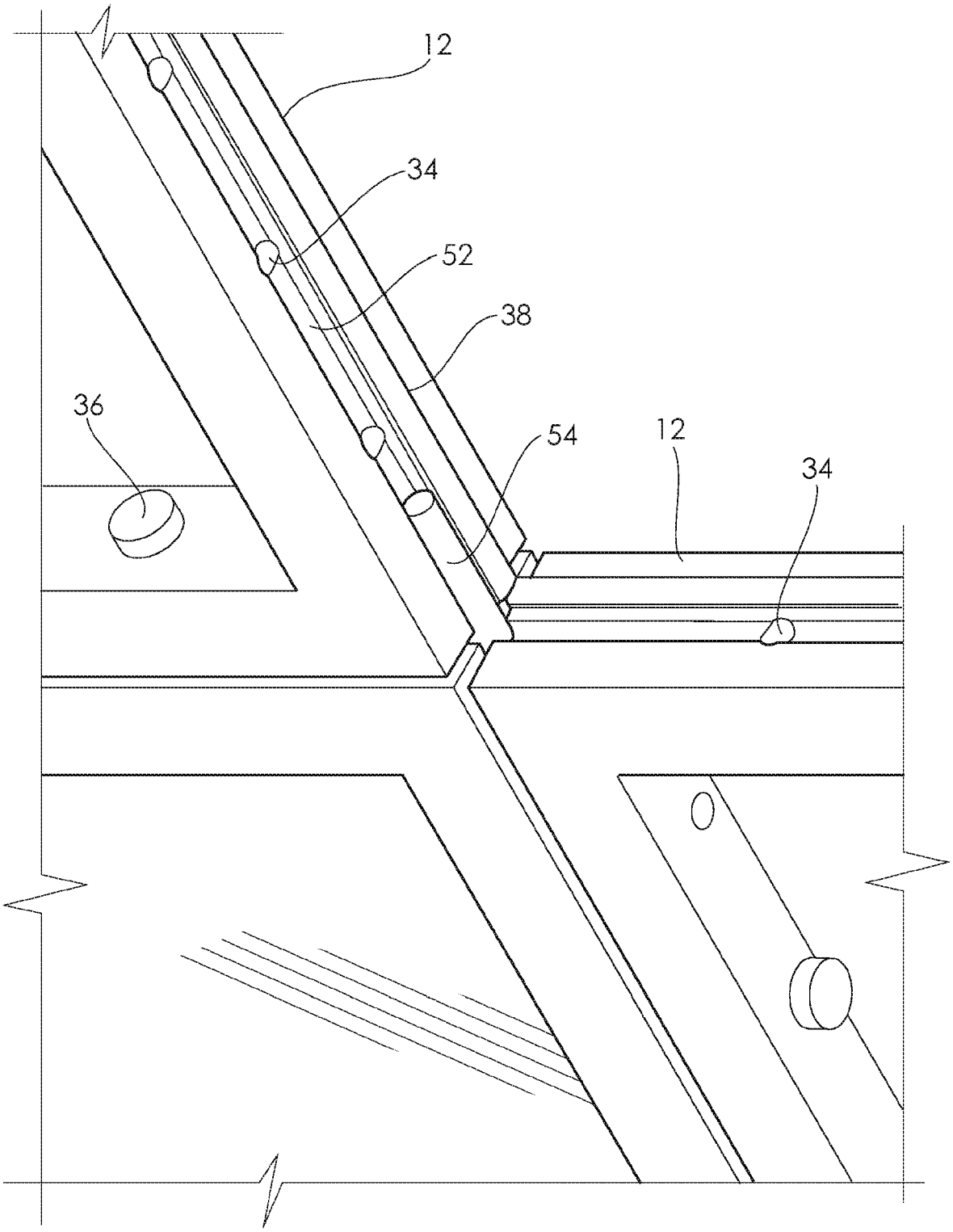
FIG. 7 is a rear side perspective view illustrating coupling between adjacent panels.
Figure 8:
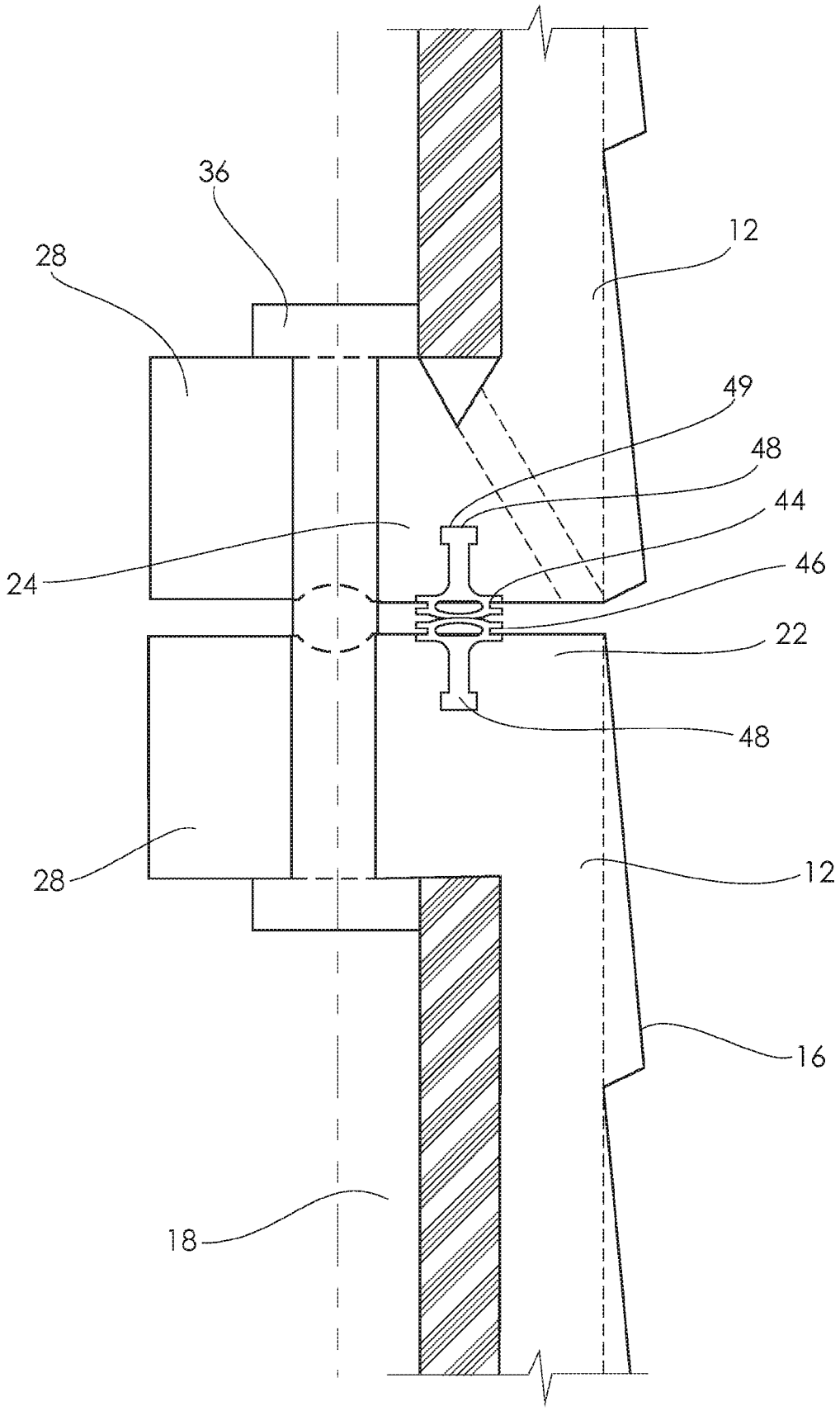
FIG. 8 is a vertical sectional view illustrating stacking up between the two panels.

Turning now to the modular panels 12 in more detail and referring to FIGS. 4 to 8, the sealing arrangement 38 includes an edge seal or sealing strip 44 extending along each of the sides 20, 22, 24 of the outer sides 32 of the frame 28 such that corresponding seals 44 of adjacently arranged ones of the plurality of panels 12 sealingly engage with one another in the fitted condition as best shown in FIGS. 6 to 8.

The seal 44 includes a head 46 and a stem 48 with a foot 49 that is embedded and anchors the seal 44 to the panel 12. The head 46 is dome shaped and includes a void so as to be resiliently depressed when adjacent seals 44 are abutted against one another in the fitted condition. The seal 44 may be a fire rated silicon rubber or equivalent and are compressed between the panels 12 in use. The seals 44, in particular, the stem 48 is embedded and cast into the panel 12 during production.

The outer sides 32 of the frame 28 of the panels 12 include elongate edged channels 52 in which the plurality of apertures 34 are located at spaced intervals within the channels 52. The end seal 44 is positioned substantially between a front side edge 50 of the panel 12 and the channel 52.

The channels 52 are arranged to receive a rod 54 as shown in FIG. 7 that assists with alignment of the panels 12 with one another as is best shown in FIG. 7. The rod 54 may be circular in cross-section and may be provided in relatively short segments that may extend between adjacent panels 12. Accordingly the channels 52 may be correspondingly curved fit with the rods 54. The rods 54 may also be fitted between the panels 12 and a concrete slab 72 as is further described below.

Figure 9:
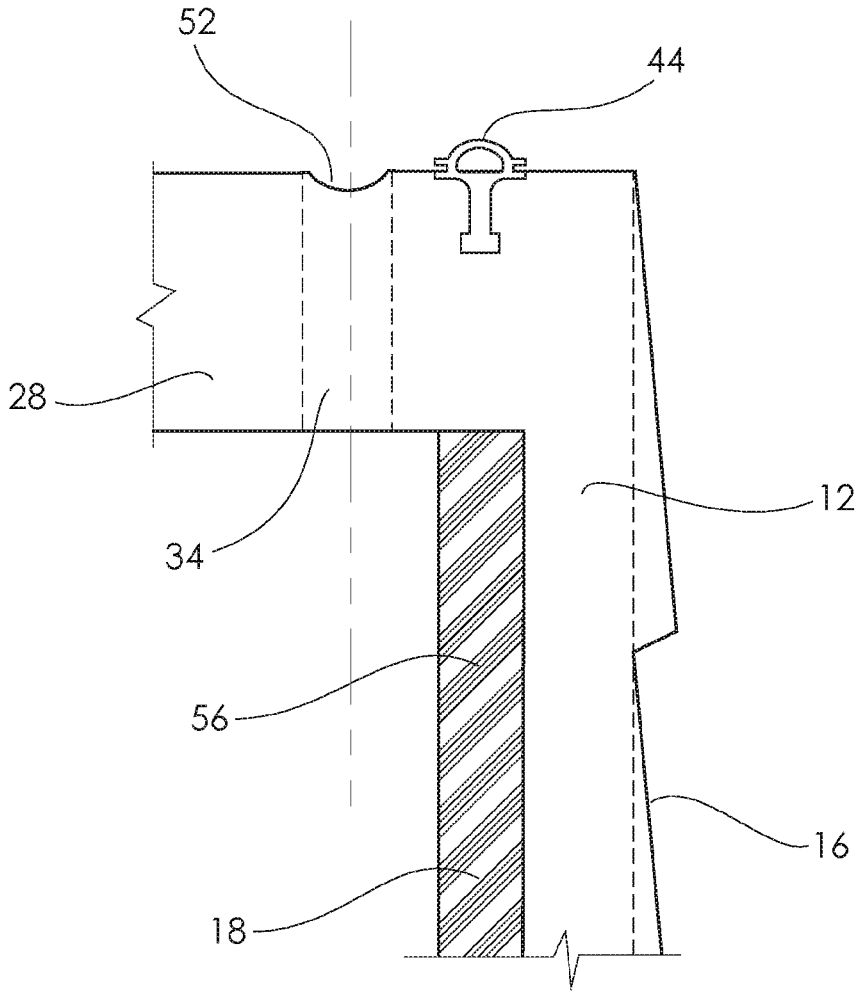
FIG. 9 is a side sectional view illustrating an internal configuration of the top section of the panel.

Referring to FIGS. 8 and 9, the panels 12 may be formed entirely of a material such as resin with a polymer binder that is cast in a mould to form the panels 12. In this example, the material of the panels 12 may be epoxy resin polymer with fillers. The panel 12 therefore may be monolithic or unitary in construction. The panels 12 may preferably also include an insulation insert board 56 that is fitted within the rebated portion 26. The insulation insert board 56 may be fitted at the time of production and may be about 10 to 20 mm thickness. Although, other suitable thicknesses may be used, as appropriate. The fasteners 36 may pass between adjacently arranged panels 12 via the plurality of apertures 34, as appropriate.

The front side 16 of the panels 12 may be formed or finished to represent a number of different surface finishes. For example, the front side 16 may be formed to represent brickwork or planks, as is shown for example in FIGS. 8 and 9. Other patterns may be possible.

Figure 10:
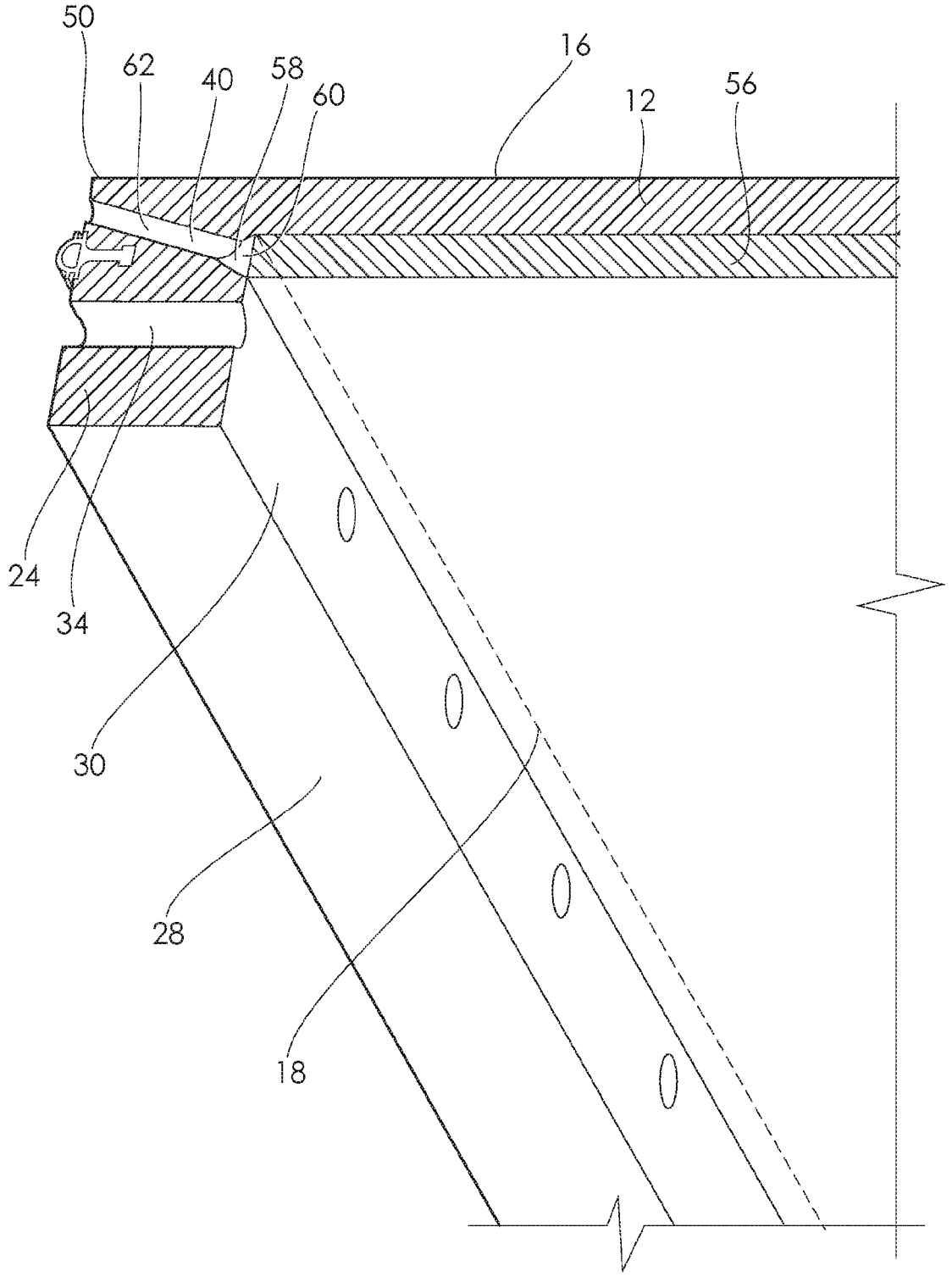
FIG. 10 is a sectional rear side perspective view illustrating a bottom section of the panel.

Referring to FIG. 10, the drain arrangement 40 is preferably provided at or towards the base side 24 of the panels 12. More specifically referring to FIG. 8 and FIG. 10, the drain arrangement 40 includes V-shaped channel 58 that extends along a lower edge junction 60 between the rebated portion 26 and the inner side face 30 of the frame 28, and a drain passage 62 that extends from the V-shaped channel 58 to the outer side 32 of the frame 28 toward the front side of the panel 16. In particular, is noted that the drain passage 62 discharges toward the front side edged 50 and toward the external environment relative to the seals 44. This ensures that any captured fluid such as condensation is ultimately discharged to the external environment.

Figure 11:
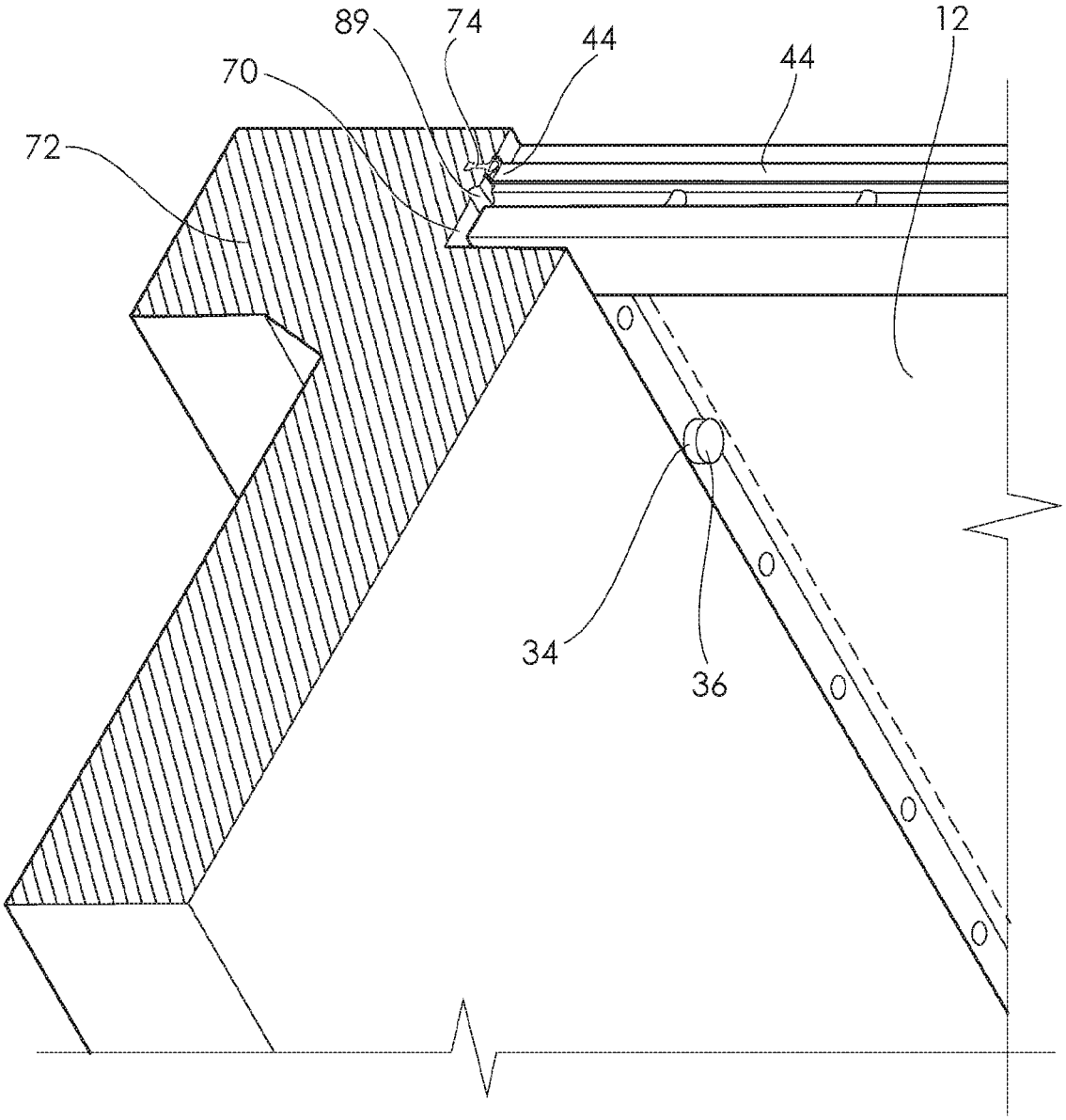
FIG. 11 is another sectional rear side perspective view illustrating the bottom section of the panel fitted to a supporting slab foundation.
Figure 12:
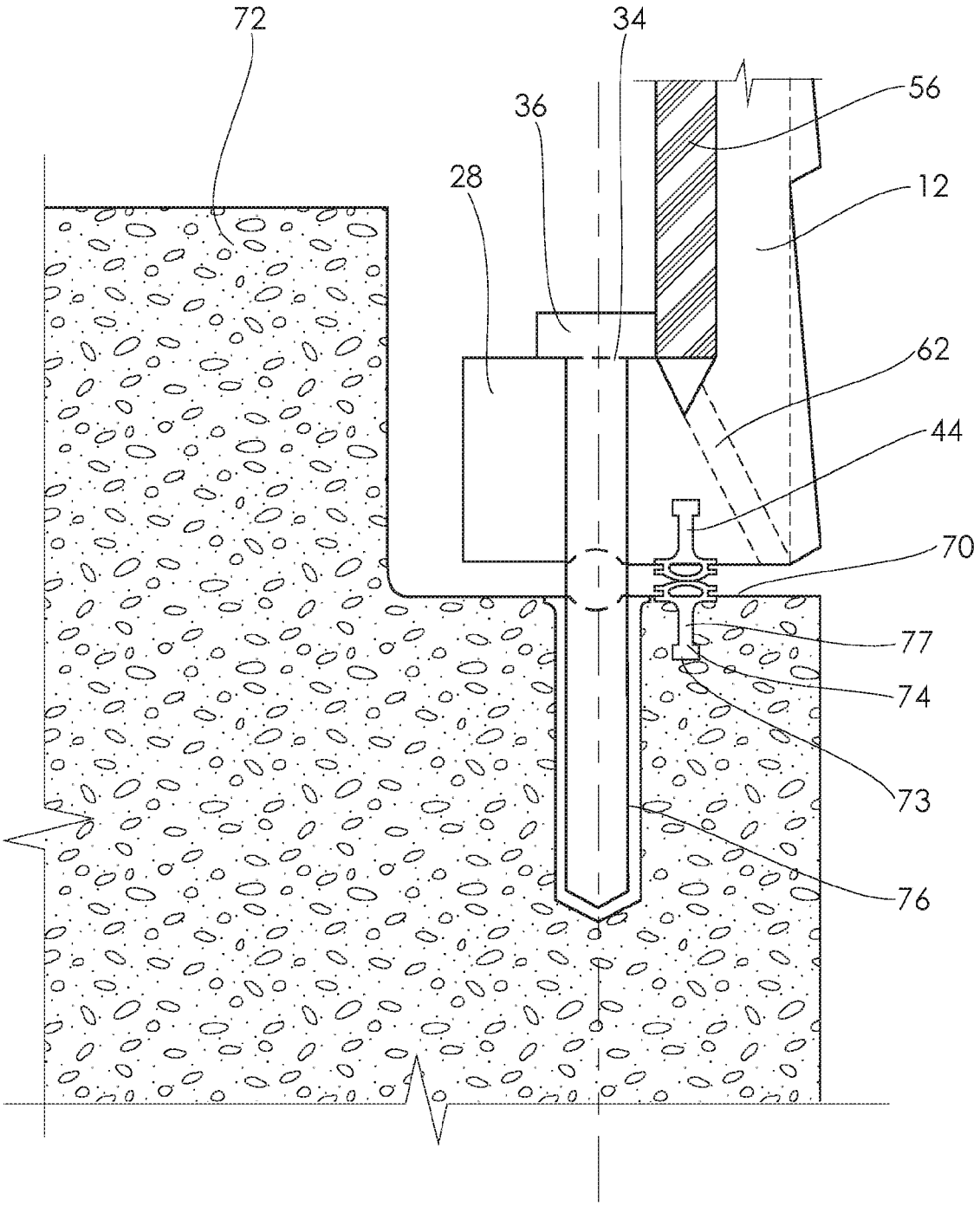
FIG. 12 is a side sectional view illustrating the panel fitted to a rebate of the supporting slab foundation.

Referring to FIGS. 11 and 12, the panels 10 may in some examples be seated in a fitted condition in a rebate 70 of the concrete slab 72. The rebate 70 of the concrete slab 72 may be fitted with a seal 74 that is arranged to sealingly engage with the seal 44 carried by the panel 12. The concrete slab 72 may include void or apertures 76 that are arranged to align with the respective one of the plurality of apertures 34 of the panels 12 so as to receive a fastener 36 to couple the panels 12 to the slab 72.

Figure 13A:
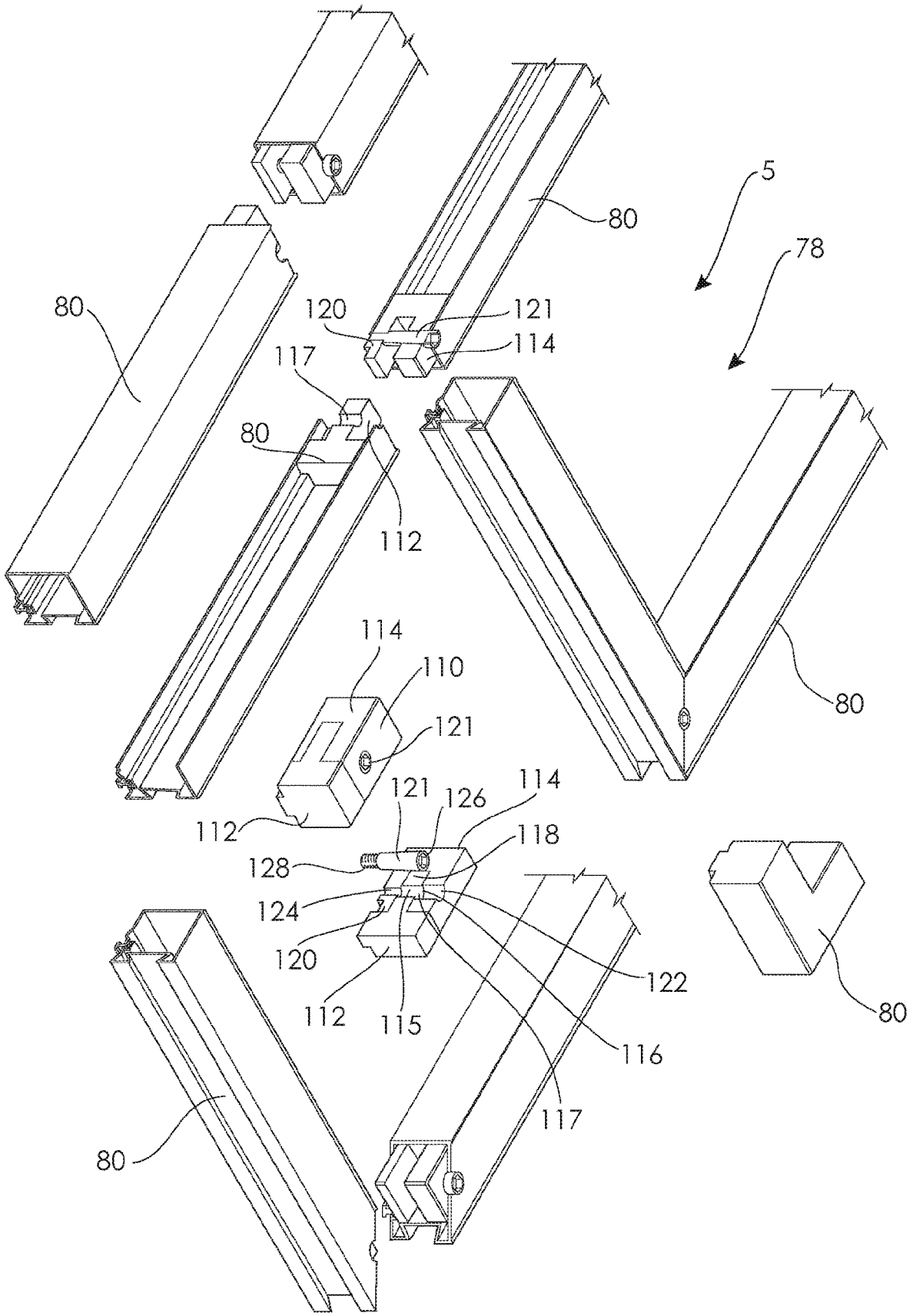
FIG. 13*a* is a perspective view illustrating components of a formwork system for forming the slab including formwork members and associated couplings.

Referring additionally to FIGS. 13*a* to 17, in this example, the building system 5 further includes a formwork system 78 that complements the panel system 10. The formwork system 78 is arranged to form the rebate 70 of the slab 72. The components of the formwork system 78 are best shown in FIG. 13*a* and include a plurality of modular formwork members 80 that generally correspond to the plurality of the modular panels 12. It is noted that the formwork system 78 may be provide as a stand-alone product or as part of the overall building system 5.

The plurality of modular formwork members 80 each include a profile section or body 82 adapted to form the rebate 70 into the cast slab 72. The rebate 70 being shaped to fit with the bottom side 24 of the corresponding one of the plurality of modular panels 12 in the fitted condition, as shown in FIG. 12. The members 80 are adapted to releasably carry the seal 74 that is released by the member 80, upon the curing of the cement of the slab 72, so as to be retained by the slab 72 in a cured condition when the member 80 is removed.

Figure 14:
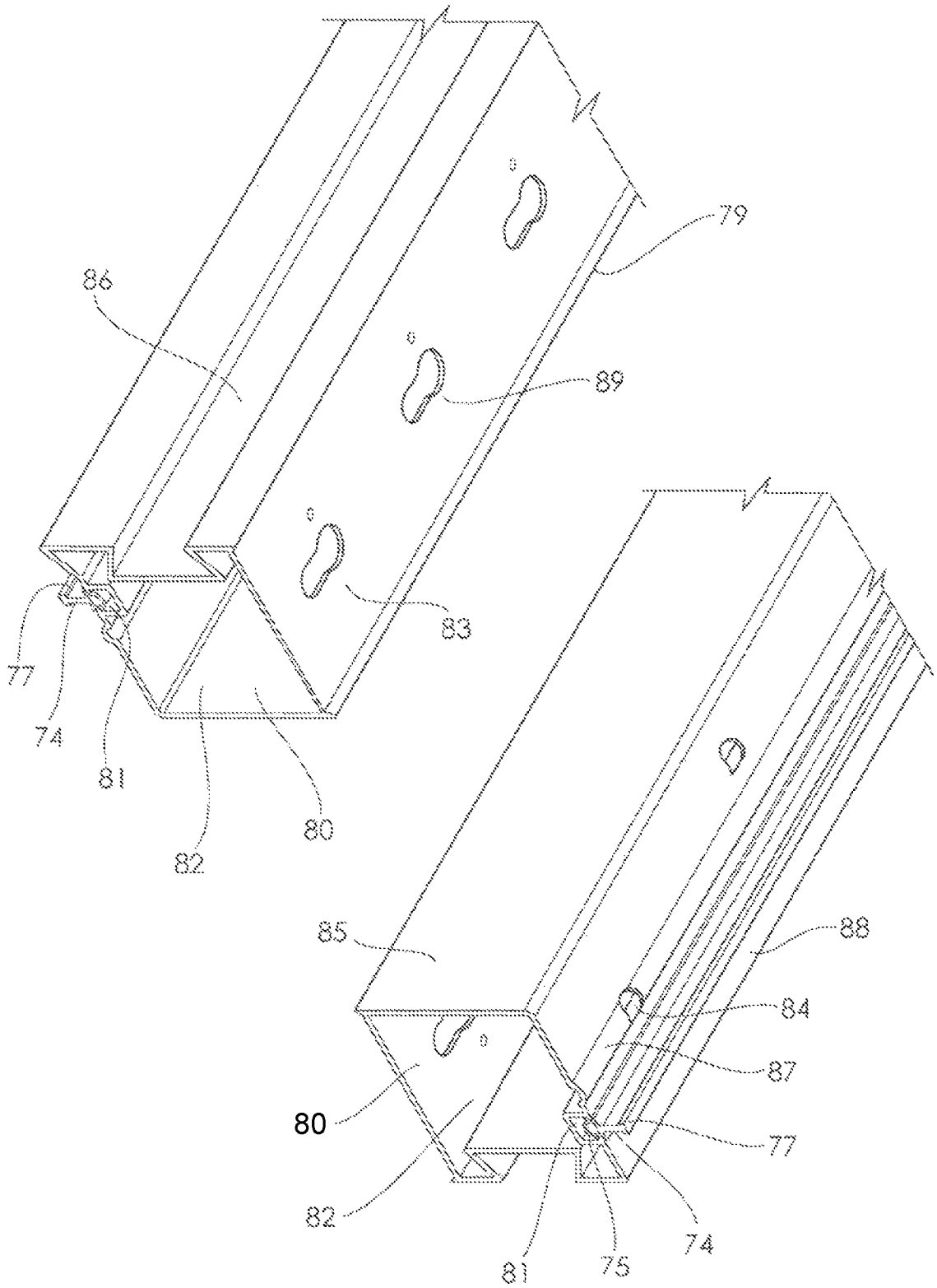
FIG. 14 provides perspective views of an underside and a top side of a formwork member.

As best shown in FIG. 14, the releasable seal 74 includes a head 75 releasable retained by a retaining channel 81 of the member 80 and an anchor stem 77 with a foot 73 extending from the head 75, the anchor stem 77 being embedded and cast into the slab 72 in the cured condition as shown in FIG. 12.

In this example, the sections 82 of the formwork members 80 are elongate hollow sections or profiles including a top side 83, a bottom side 84, an inner side 85 and an outer side 86. The bottom side 84 includes the retaining channel 81 into which the releasable seal 74 is initially fitted. The bottom side 84 also includes a convex curved rib or locator 87 that includes a plurality of apertures 88 that are arranged to align with the plurality of apertures 34 of the panels 12. The curved rib 87 forms a complimentary channel 89 (shown in FIG. 11) within the cured slab 72 and allows the alignment rods 54 to be fitted between the slab and the panels 12 to assist with location and alignment between the slab and the panels 12. The sections 82 may be formed form aluminium extrudes. In use, the complimentary channel 89 is relatively inside of the releasable seal 74 that forms an outer barrier to the external environment.

The topside 83 of the sections 82 include a further aperture 69 that allows a void forming tool or part 90 to be inserted and removed from the topside 83. The void forming tool 90 is used to form the apertures 76.

Figure 15:
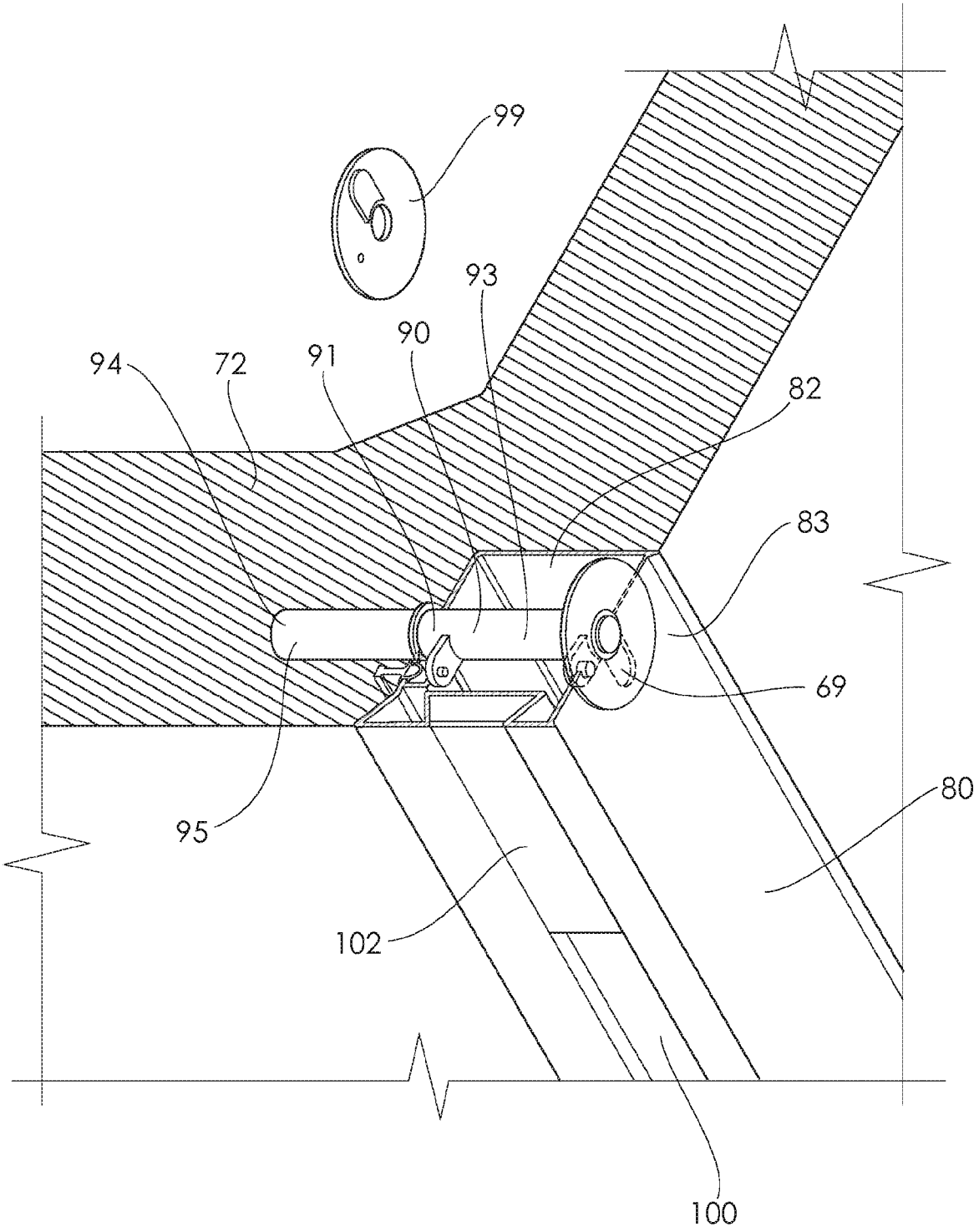
FIG. 15 is a sectional perspective view illustrating a formwork member fitted to a slab with a void forming tool.
Figure 16:
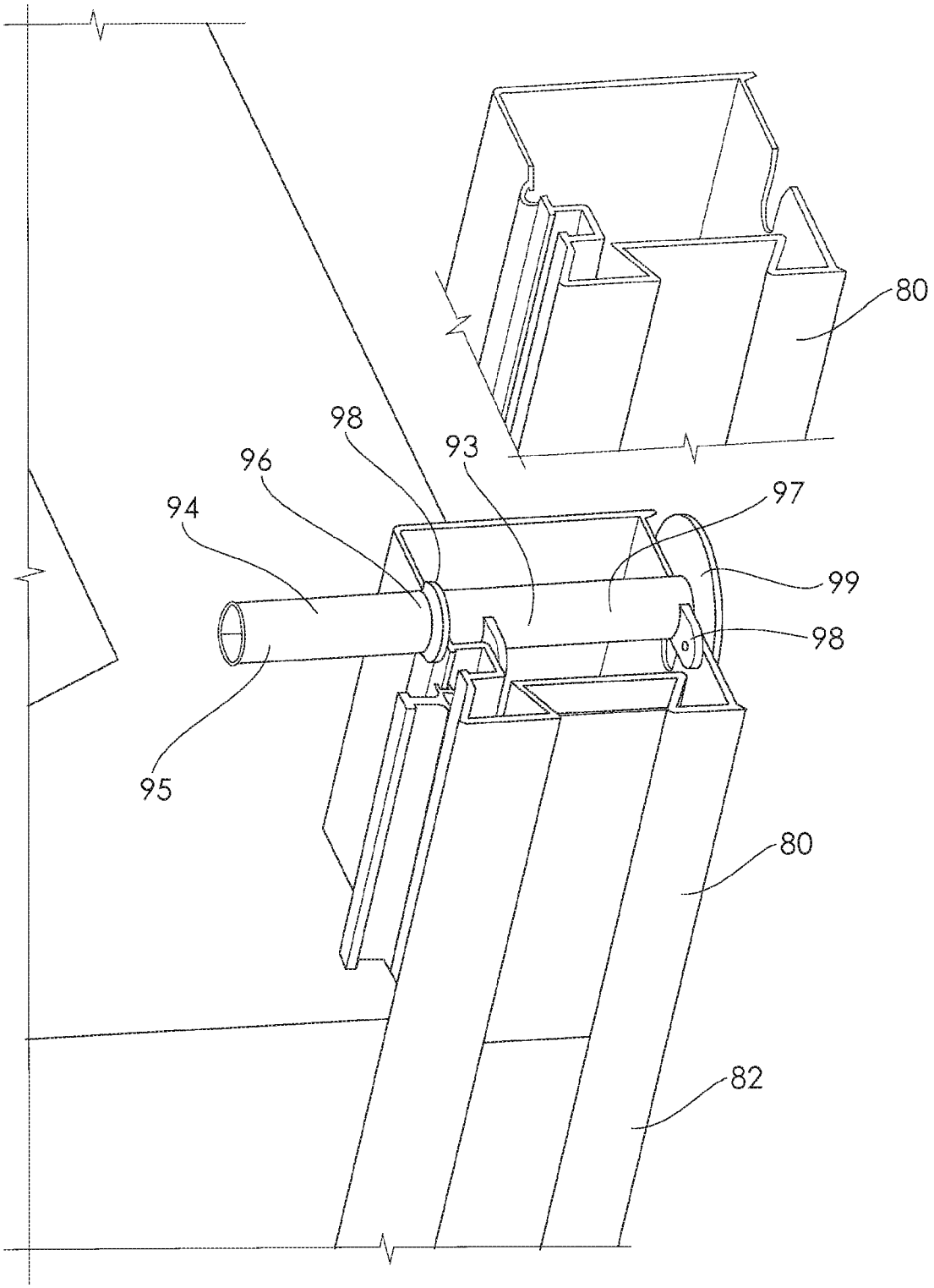
FIG. 16 is an underside sectional perspective view illustrating the formwork member, the void forming tool and a releasable seal carried by a channel on the underside of the formwork member.

Referring more specifically to FIGS. 15 and 16, the void forming tool 90 may include an elongate hollow cylindrical body 91 having a length to extend from the topside 83 through the apertures 88 of the bottom side 84 and extend into the slab 72. The void forming tool or part 90 includes a retaining section 93 having an elongate body 97 that is fitted generally within the section 82 and a removable or consumable void forming insert 94 that is cast into the slab 72 and remains with the slab 72 when the formwork members 80 are removed.

The void forming insert 94 includes an elongate hollow cylindrical body being blinded at one end 95 by a slightly pointed tip and includes a flared opening 96 initially carried immediately below the bottom side 84 of the member 80 so as to be aligned with a top surface of the slab 72 in the cured condition when the formwork members 80 are removed. The retaining section 93 may include tabs 98 that are arranged to allow the retaining section 93 to be coupled with the section 80. The apertures 69 of the topside 83 are shaped to selectively allow the retaining section 93 and the tabs carried thereby to pass through the apertures 69. The apertures 69 and tops of void forming tool 90 may be covered by a cap 99 to inhibit the passage of concrete into the void forming tool 90.

The inner side 85 is relatively flat to provide a corresponding flat slab surface and includes an upturned edge lip 79. It is noted that the upturned edge lip 79 may end in a small flat edge, for example being 10-15 mm wide, for durability. The edge 79 may also be hardened such as by inclusion of wear part such as an imbedded stainless steel edge or part. The edge 79 allows any aggregate or slurry that rolls off the slab falls into the trough behind the edge and not to obstruct the finisher from achieving an accurate line against the top edge of the formwork member 80.

Figure 17:
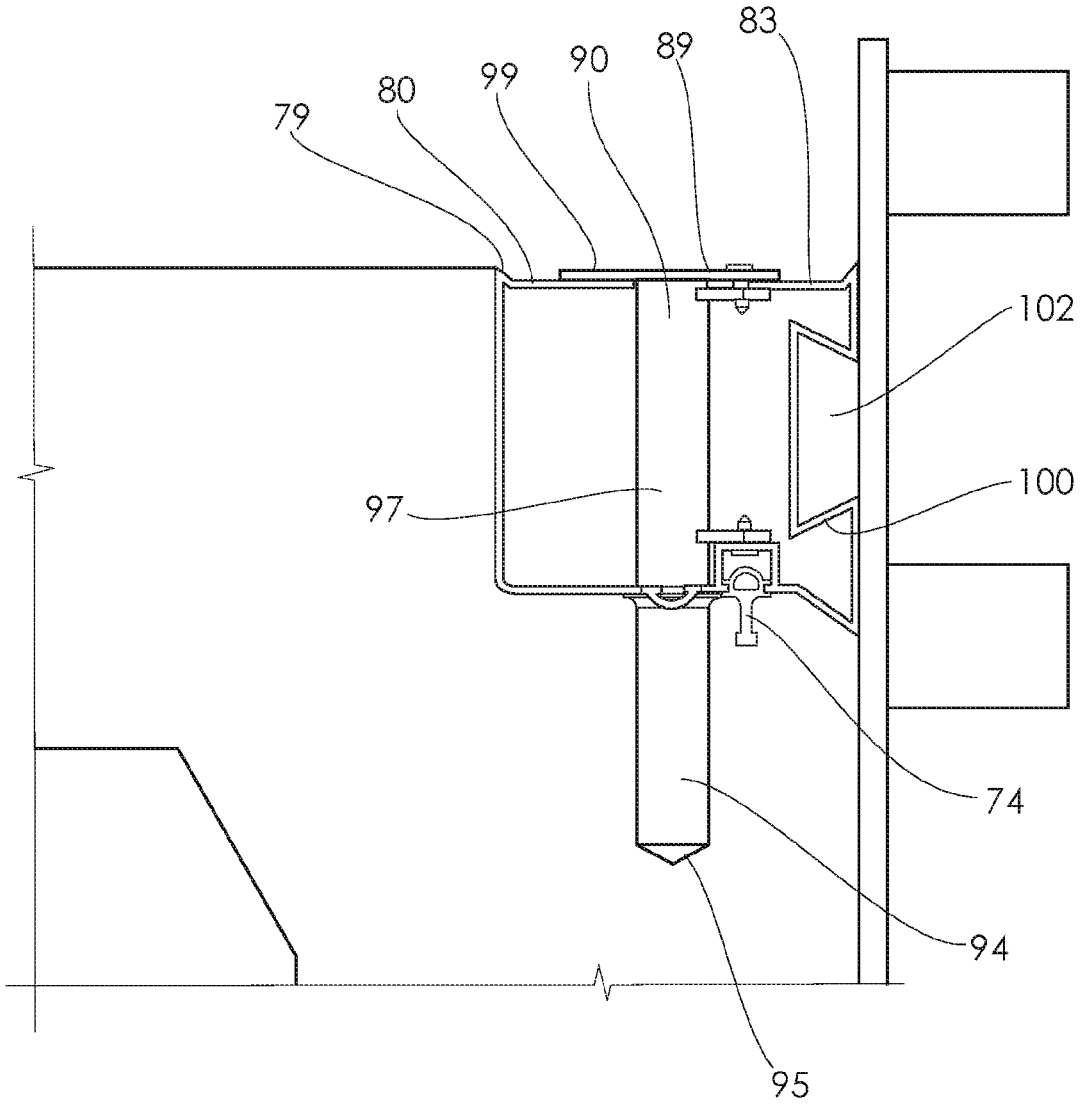
FIG. 17 is a side sectional view illustrating the formwork member being coupled to further external formwork.

The outer side 86 includes dove tail shaped recess 100 into which a corresponding dove tail shaped insert 102 is fitted. The dove tail shaped insert 102 may be formed from a material that is able to be nailed or drilled such a plywood or plastic and allows the formwork section 80, that may be formed from a plastic or a metal such as aluminium, to be secured to external plywood supports as shown in FIG. 17 by a nail, screw or the like.

Figure 13B:
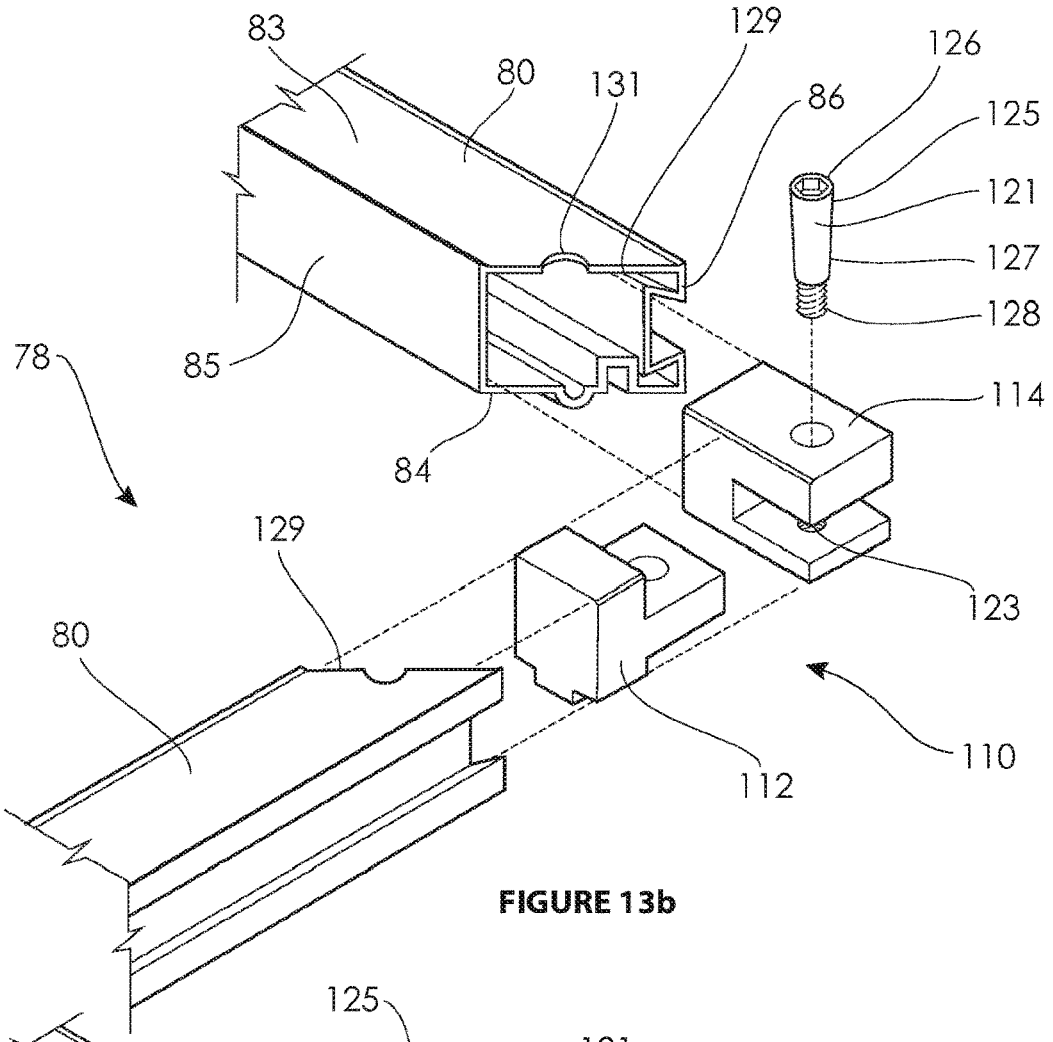
FIG. 13*b* is an exploded parts perspective view of the formwork system showing illustrating a perpendicular example of the coupling between formwork members.
Figure 13C:
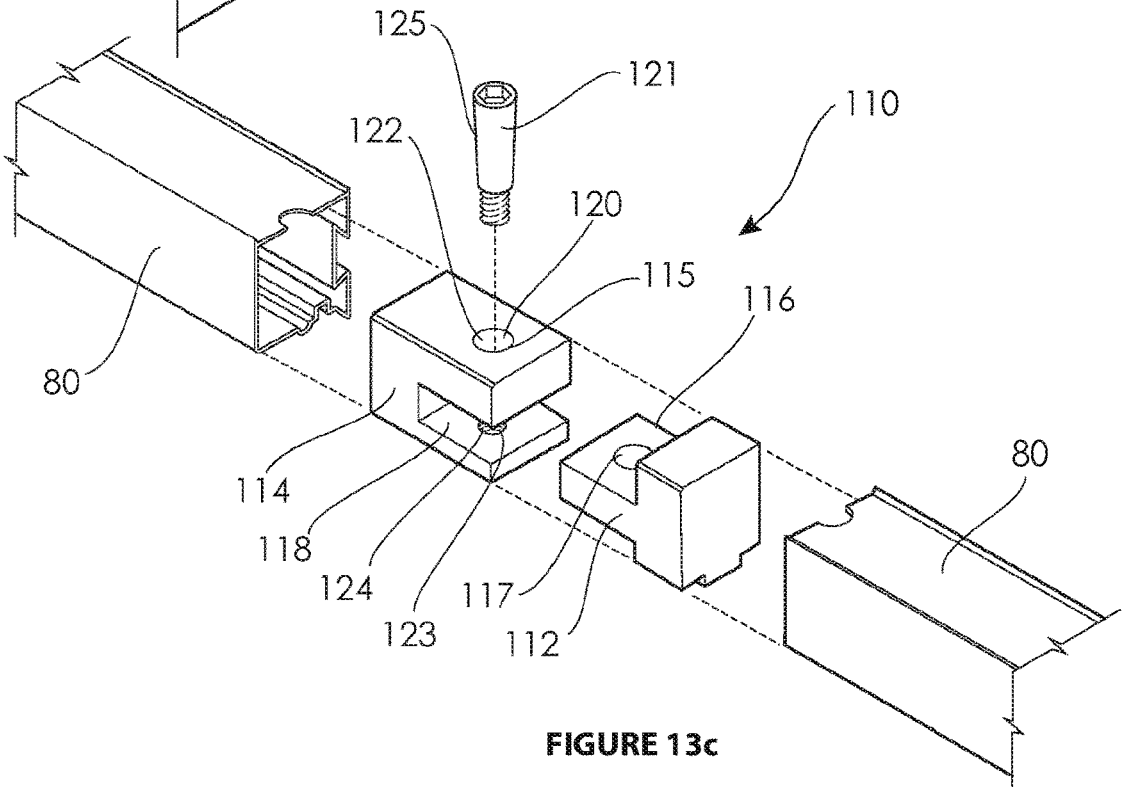
FIG. 13*c* is an exploded parts perspective view of the formwork system showing illustrating a straight example of the coupling between formwork members.

Referring more specifically to FIGS. 13*a* to 13*c*, each of the formwork members 80 are adapted to couple with one another via a coupling 110. The coupling 110 includes a male side or first part 112 and a female side or second part 114 that are provided at the free ends of the respective ones of the formwork members 80. The male part 112 and the female part 114 are each arranged to be received by or formed with the open section of the formwork members 80. The male part 112 includes a tongue 116 that is received by a recess 118 of the female part 114. The tongue 116 and recess 118 being coupled by a fastener 121.

The arrangement of the coupling 110 is such that the inter fit between adjacent coupled formwork members 80 is generally flush and continuous with adjacent sides edges 129 of the top side 83, the bottom side 84, the inner side 85 and the outer side 86 are generally abutting with one another. The adjacent sides edges 129 of the top side 83 include a cut out 131 for fastener 121.

This allows the coupling formwork members 80 to provide substantially smooth elongate and corner forms in a variety of shapes and sizes. The side edges 129 are generally recessed back from the male part 112 and the female part 114, and may be shaped in plan form view to be straight to provide straight couplings between the formwork members 80 or the side edges 129 may include 45 degree angles in plan form view to allow a mitre or 90 degree coupling between the formwork members 80. It is noted that the coupling 110 can remain the same with shape of the relevant abutting side edges 129 defining the angle of the joint. Other arrangements include a step down arrangement in which at least one formwork member 80 extends vertically downwardly to accommodate step down in the slab.

In more detail, the male and female parts 112, 114 include corresponding apertures 117, 120, 123 that form a passage 115 through which the fastener 121 is fitted to secure the male and female parts 112, 114 together. The tongue 116 includes aperture 117 and the flanking members 119 that the define the recess 118 female part 114 each include apertures 120, 123 with the lower most aperture 123 having a thread to couple with the fastener 121. The upper aperture 120 is tapered and aperture 123 is threaded.

The passage 115 and fastener 121 are inwardly tapered between an entry end 122 and an opposing end 124 of the passage 115 such that movement of the fastener 121 between the entry end 122 and the opposing end 124 drawing the male and female parts 112, 114 into aligned abutment via a wedge like fit. This assists to draw the respective formwork members 80 into abutting alignment thereby providing accuracy and repeatability to the formwork system 78.

The tapered fastener 121 includes a tapered body section 125 with a head 126 and a threaded end 128 that is threadedly engaged with a corresponding female thread provided on a lowermost aperture 123 of the female part 114. The tapered fastener 121 includes an inward step 127 between tapered body section 125 and threaded end 128 that is relatively straight. Accordingly, the tapering between the tapered body section 125 and the upper aperture 120 provides the self-alignment function and the relatively straight threaded end 128 provides the coupling with the step 126 providing an end of travel stop.

The head 126 may include a fitting such as a hex drive. It is noted that the male and female parts 112, 114 may be used to couple straight sections or to couple internal or external corners, as is shown in FIGS. 13*b* and 13*c*.

Figure 18:
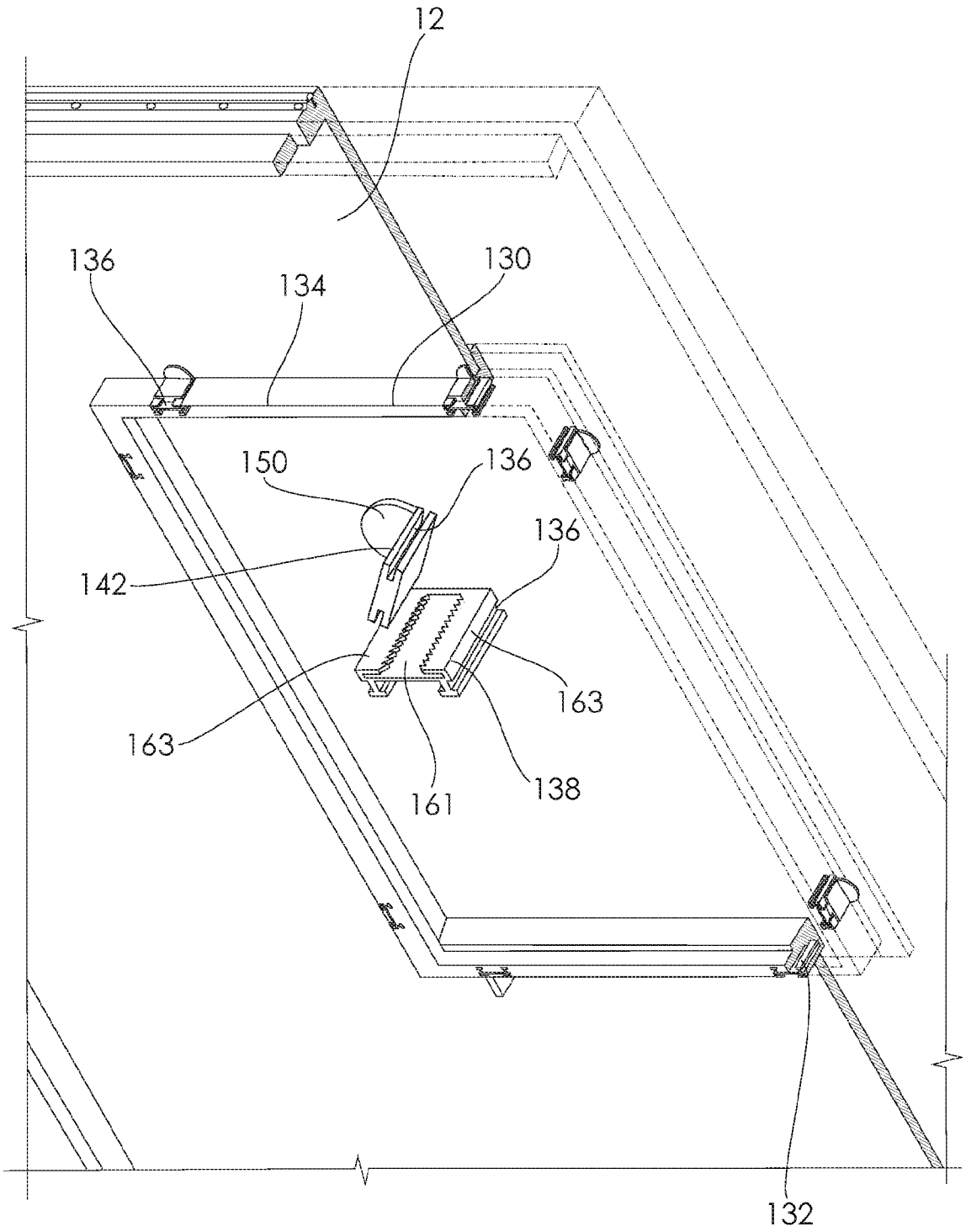
FIG. 18 is a rear side partial cutaway perspective view illustrating a panel with a door or window opening and a reveal arrangement fitted to the door or window opening.
Figure 19:
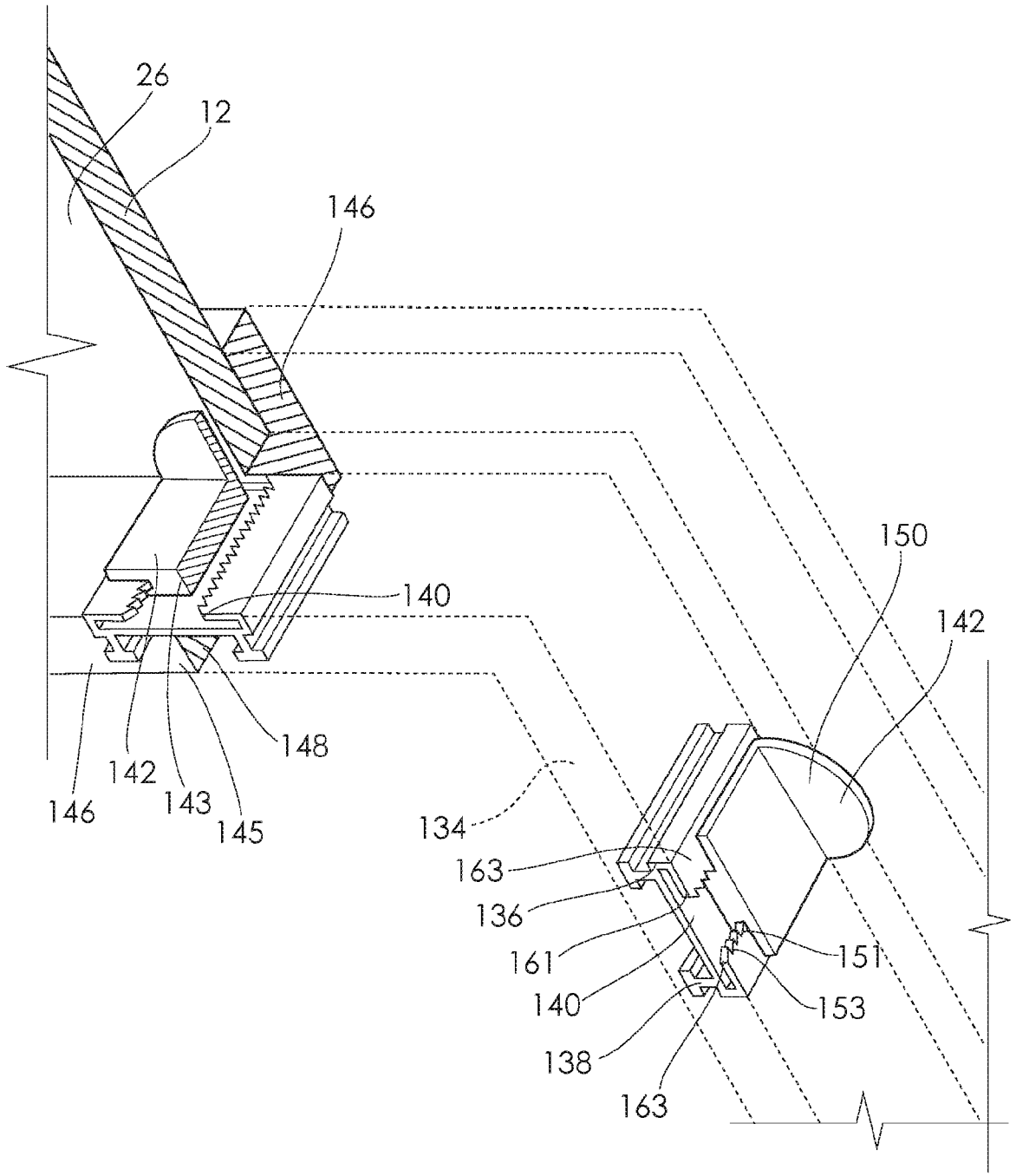
FIG. 19 is a rear side partial cutaway perspective view illustrating parts of the reveal arrangement fitted to the panel.

Referring now to FIGS. 18 to 19, the panel system 10 may include a window or door reveal retaining arrangement 130 to fit with a door or window opening 132 of one of the panels 12. The reveal retaining arrangement 130 includes a cast reveal structure 134 that is formed from a concrete polymer or epoxy resin polymer with filler, and a series of fittings 136 that are cast into the reveal structure 134. The fittings 136 include a base 138 adapted to anchor the fitting 136 into the reveal structure 134 and a coupling portion 140 that is adapted to receive and lock with a clamping part 142. The clamping part 142 includes a coupling portion 143 adapted to couple with the receiving portion 140 of the fitting 136 and a bearing pad 150 that bear against a face of the rebated portion 26 in a fitted condition.

The reveal structure 134 includes a skirting frame 145 with a flange 146 that fit against a front face of the panel 12 laterally of the door or window opening 132. The frame 142 also includes a inner section 148 that extends from the flange 146 through the door or window opening 132 and extends into the void of the rebated portion 26 on the backside of the panel 12.

The fittings 136 are located on the inner section 148 so that when the inner section 148 is fitted through the door or window opening 132 and the flange 146 abuts the front side of the panel, the clamping part 142 can be fitted to the fitting 136 and received by the coupling portion 140 thereof. The coupling portion 140 of the fitting 136 and the coupling portion 143 of the clamping part 142 are adapted to couple and interlock with one another to secure the reveal structure 134 to the door or window opening 132.

In this example, the coupling portion 140 of the fitting 136 and the coupling portion 143 of the clamping part 142 each include uni-direction interlocking teeth 151, 153. The coupling portion 140 of the fitting 136 includes lengthwise slot 161 flanked by inward facing flanges 163 that terminate at the teeth 151. The coupling portion 143 of the clamping part 142 includes slots or channels 165 on opposing sides thereof that receive the inward facing flanges 163 of the coupling portion 140 of the fitting 136 so that the teeth 151, 153 engage and interlock with one another. The clamping part 142 is advanced on the teeth 151, 153 so that the panel 12 is clamped between the flange 146 of the reveal structure 134 and the bearing pad 150 of the clamping part 142.

Figure 20:
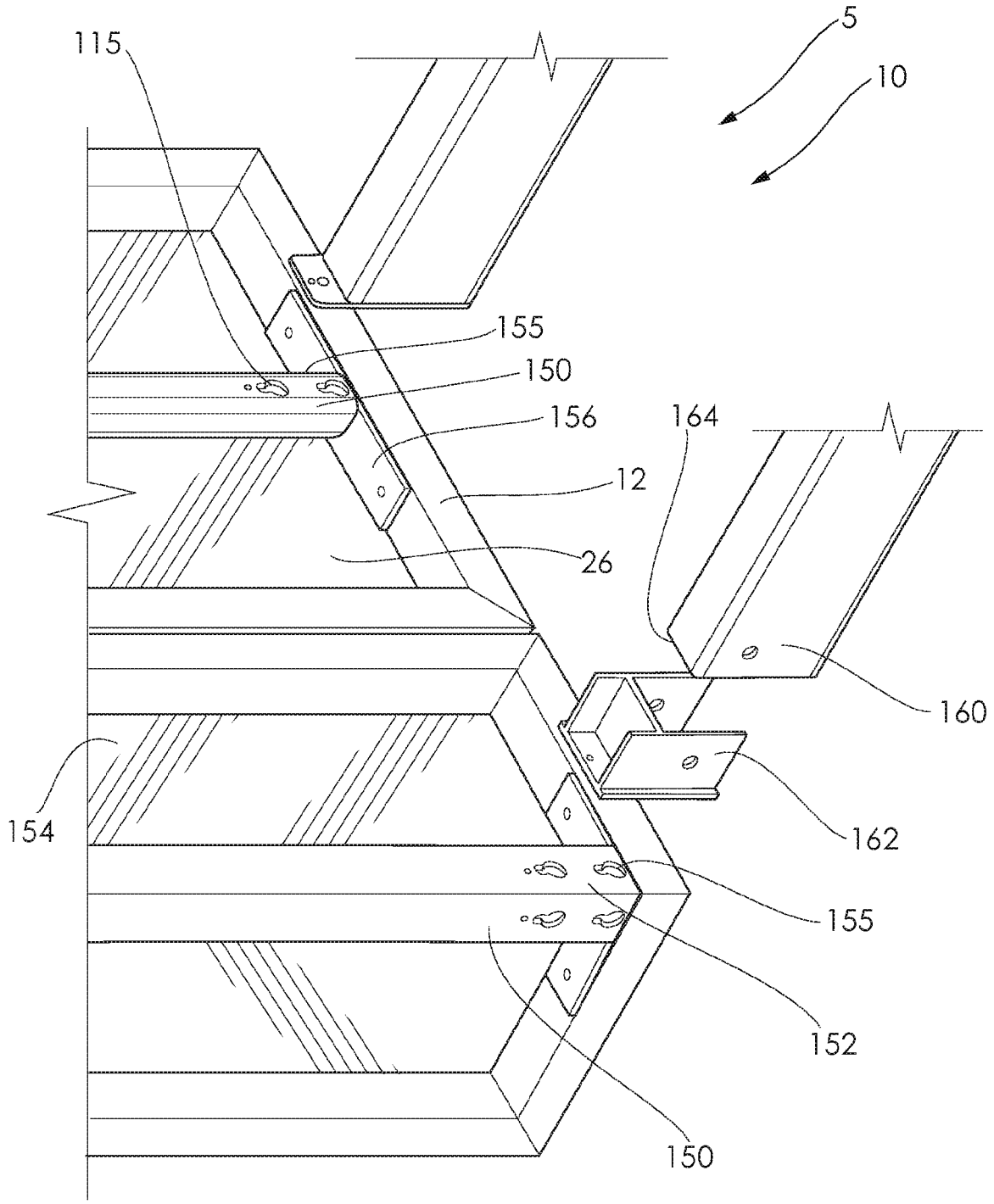
FIG. 20 is a rear side partial cutaway perspective view illustrating vertically arranged structural support members fitted to the panels and horizontal structural members adapted to couple with the vertical support members.
Figure 21:
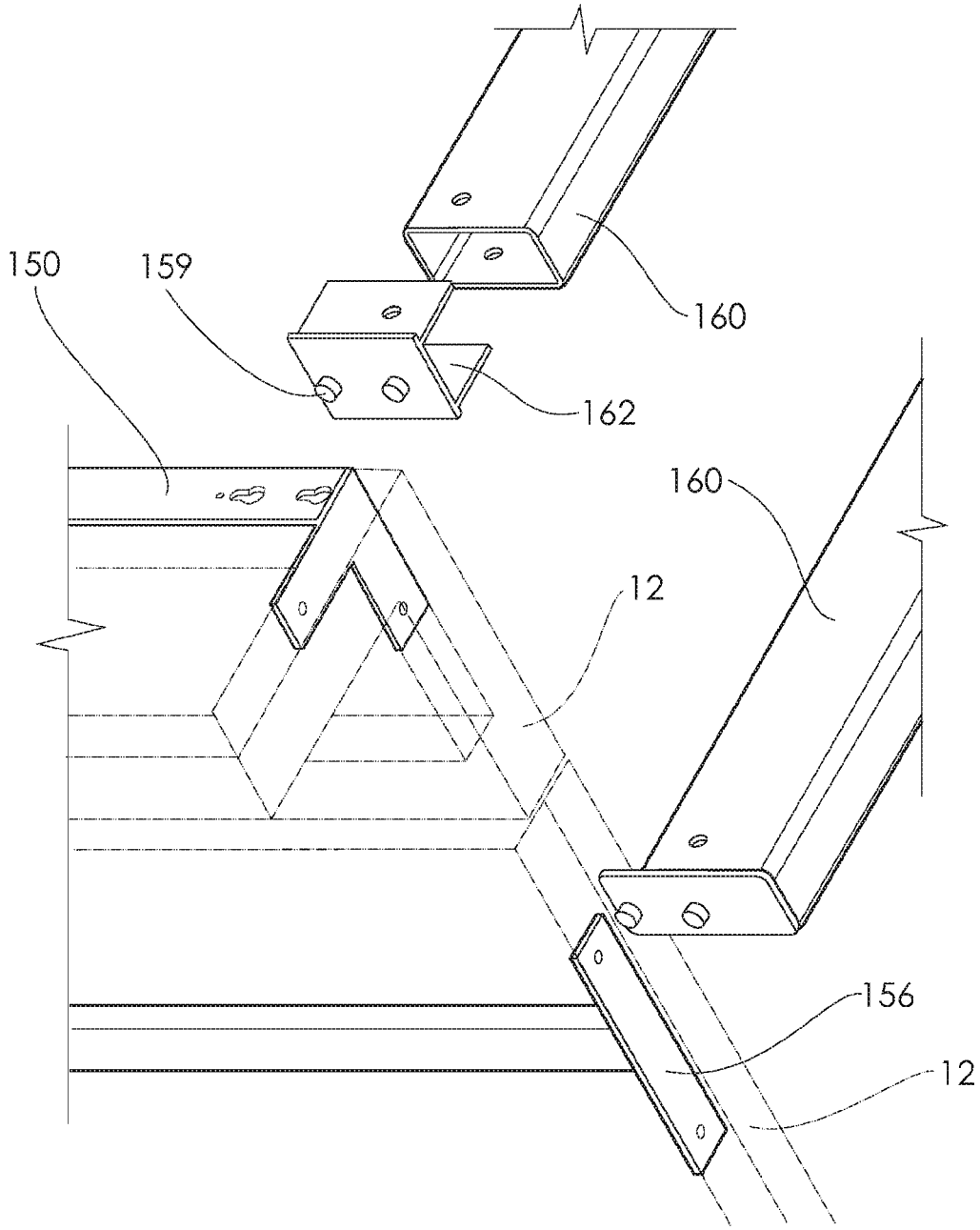
FIG. 21 is a front side partial cutaway perspective view illustrating vertically arranged structural support members fitted to the panels and horizontal structural members adapted to couple with the vertical support members.
Figure 22:
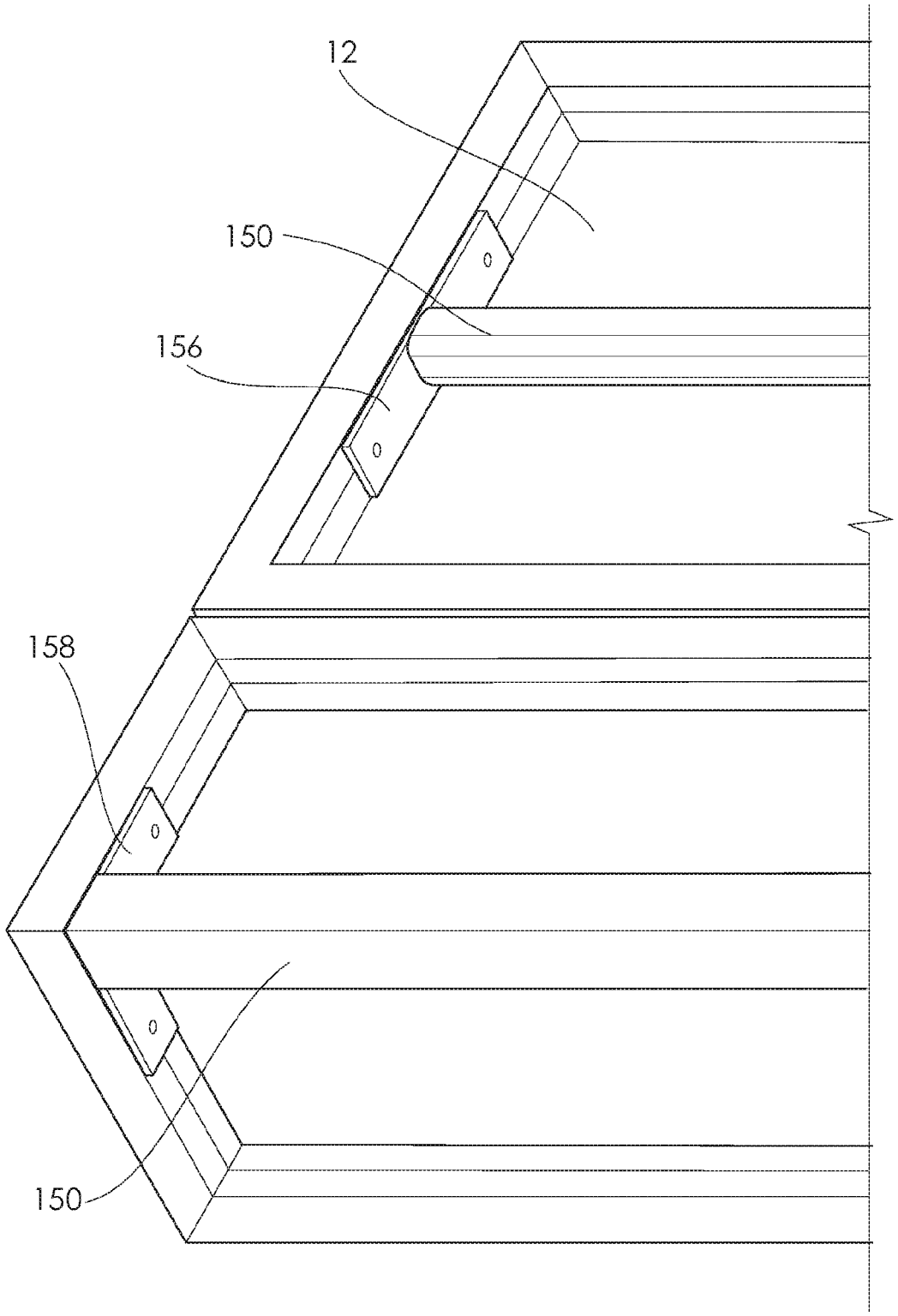
FIG. 22 is a perspective backside view of bottom portions of the panels being fitted with the structural support members.

Referring now to FIGS. 20 to 22, the building system 5, in particular the panel system 10, may further include structural members 150 arranged to support the panels 12. The more specifically, in this example, the structural members 150 are arranged to fit within and vertically span the rebated portion 26 between the skirting rib 29 of the frame 28. The structural members 150 each include an elongate body 151 having opposing ends 152, 154 that each include flanges 156, 158 that abut in the fitted condition with the inner side 30 on the frame toward the topside 22 and the bottom side 24 of the panel 12, respectively. The flanges 156, 158 each include apertures that of line with respective ones of the plurality of apertures 34 of the panels 12.

The structural members 150 may also be adapted to directly support further horizontal structural members 160. The structural members 150 may include sockets 155 toward each of the top ends 152 into which spigots 159 carried the horizontal structural members 160 are received. The horizontal structural members 160 may be fitted with an adapter bracket 162 that plugs into and is coupled to an open end 164 of the horizontal structural members 160 and the adapter may carry the spigot 159. The arrangement of the spigots and the sockets may of course be reversed. Accordingly, in the fitted condition, the structural members 150 provide substantial structural support to the panels 12 thereby allowing the panels 12 to be load-bearing and be coupled to further horizontal structural members 160.

A method of use of the building system 5 includes forming the panels 12 of the building system 5 that is typically conducted off-site. The panels 12 are formed in a series or set of predetermined sizes that fit with the predetermined grid and the sizes are selected to skirt or provide the desired building wall structure. The set of panels 12 are formed in a mould (or the set sizes of panels may be preformed) as has been aforementioned. The panels 12 may be formed with window or door openings 132 in the panels, and fitting the window or door reveal retaining arrangement 130 to the openings 132. The panels 12 and associated components of the panel system 12 such as the rod 54 and the structural members 150 are transported to site. The window or door openings 132 may be cut out with a machine such as a CNC (Computer Numerical Code) machine after the panels 12 are formed.

The associated set of formwork members 80 and the formwork system 78, which are typically pre-formed to correspond with particular panels 12, are also transported to site where the formwork members 80 are located and coupled with one another via the coupling 110 to form the rebate 70 of the concrete slab 72. Use of the coupling 110 includes fitting the male side or part 112 and the female side or part 114 of the coupling 110 together such that corresponding apertures 117, 120 that form the passage 115 through which the tapered fastener 121 is fitted to secure the male and female parts 112, 114 together. The fastener 121 is then actuated to allow self-alignment of the adjacent formwork members 80.

The formwork members 80 each carry the releasable seal 74 that is embedded in the slab 72 once cured and the void forming tool 90 provides the apertures 76 that are arranged to align with the respective one of the plurality of apertures 34 of the panels 12 so as to receive the fastener 34 to couple the panels 12 to the slab 72. The curved rib 87 of the formwork members 80 is used to provide or form the channel 89 parallel to relatively inwardly of the seal 74.

Once the slab 72 is cured, the formwork system 78 is removed leaving behind the releasable seal 74 and the insert 94 of the void forming tool 90 is cast into the slab 72. The lower alignment rod 54 may be fitted along some or substantially the entire channel 89 between any fasteners 36.

The set of panels 12 may be fitted to the slab 72 and coupled thereto by fasteners 36 passed between the respective ones of the plurality of apertures 34 of the panels 12 and the apertures 76 of the slab 72. The rod 54 may be used to assist to align the panels 12 with one another and the panels 12 may be coupled to one another via fasteners 36 passed through the appropriate ones of the plurality of apertures 34.

The corresponding seals 44 are sealingly engaged with one another to provide a seal between the panels 12. The panels 12 may be stacked and/or bolstered using the vertical structural members 150, as required. The further horizontal structural members 160 may also be fitted to the vertical structural members 150.

The building system including the panel system and formwork system as described herein provide a number of advantages including, but not limited to, one or more of the following:

- Fits with or is compatible with existing building practices—such as fitting with a typical slab construction that is now used to support brick veneer walls;
- Panels have a pre-engineered construction and may be selected from a predetermined range of sizes thereby reducing tooling, procurement costs and lead times;
- Quick installation due to ease of fastenings and pre-alignment with predetermined grid formed into the slab;
- Lightweight panels only requiring, perhaps, one crane set up on a kerbside;
- High degree of flexibility due to the range of predetermined sizes and shapes of panels;
- Reusable formwork system that is predetermined to fit with associated panels to ensure a correct fit and alignment;
- Self-aligning coupling between formwork members;
- Improved sealing by having a releasable seal that becomes embedded within the slab and also having pre-fitted seals between the panels;
- Improve drainage by having a drainage passage that extends from and inner side of the panel to an outer side of the panel; and
- Panels may be optionally bolstered by structural members including vertical structural members that fit within a rebate of the panels so as to fit substantially flush therewith; and
- Rebate portion of the panels allows further insulation panels to be fitted to the panels.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any known matter or any prior publication is not, and should not be taken to be, an acknowledgment or admission or suggestion that the known matter or prior art publication forms part of the common general knowledge in the field to which this specification relates.

While specific examples of the invention have been described, it will be understood that the invention extends to alternative combinations of the features disclosed or evident from the disclosure provided herein.

Many and various modifications will be apparent to those skilled in the art without departing from the scope of the invention disclosed or evident from the disclosure provided herein.

The claims defining the invention are as follows:

1. A building system including a panel system and an associated removable formwork system, the panel system including a plurality of preformed modular panels arranged to fit with one another in a predetermined regular grid arrangement to form coextensive side walls of a building in a fitted condition, the plurality of preformed modular panels including one or more preformed straight panels and one or more preformed corner panels arranged to allow a change in direction between successive ones of the one or more preformed straight panels, wherein each of the one or more preformed straight panels and the one or more preformed corner panels include a front side, a back side, a bottom side, a topside, and opposing sides arranged to abut with an adjacent one of the plurality of preformed modular panels;

wherein at least the bottom sides of each of the one or more preformed straight panels and the one or more preformed corner panels include a plurality of apertures that are arranged at predetermined spaced apart locations therealong so as to coincide with the predetermined regular grid arrangement, and wherein the one or more preformed straight panels and the one or more preformed corner panels are dimensioned such that the opposing sides thereof coincide with the predetermined regular grid arrangement thereby allowing junctions therebetween to coincide with the predetermined regular grid arrangement without in-situ modification of the preformed modular panels, wherein the back side of each of the one or more preformed straight panels and the one or more preformed corner panels includes a rebated portion skirted by a frame, the frame includes an inner side oriented toward the rebated portion and an opposing outer side, and the outer side of the frame includes a sealing arrangement, wherein the formwork system includes a plurality of modular formwork members that are adaptable to correspond to the plurality of the preformed modular panels, the plurality of modular formwork members each include a body adapted to form a rebate into a cast slab, the rebate being shaped to fit with the bottom side of a corresponding one of the plurality of preformed modular panels in the fitted condition, and wherein the body is adapted to carry void formers that are arranged to form slab apertures that are aligned with at least some of the plurality of apertures of the corresponding plurality of preformed modular panels, wherein the body is adapted to carry a seal that is released by the body so as to be retained by the slab in a cured condition when the body is removed, the seal retained by the slab positioned to be aligned with the sealing arrangement of the frame.

2. The building system according to claim 1, wherein the opposing sides of each of the one or more straight panels and the one or more corner panels include channels such that the junctions between adjacent panels form junction apertures that coincide with the predetermined regular grid arrangement.

3. The building system according to claim 1, wherein the plurality of apertures of each of the one or more straight panels and the one or more corner panels are adapted to receive a fastener so as to allow at least some of the plurality of apertures of each of the one or more straight panels and the one or more corner panels to be securable to a supporting structure having likewise arranged apertures arranged to coincide with the predetermined regular grid arrangement.

4. The building system according to claim 1, wherein the top side includes a further plurality of apertures at spaced apart locations along the topside so as to coincide with the predetermined grid arrangement.

5. The building system according to claim 1, wherein the plurality of apertures are arranged to pass between the inner side and outer side of the frame.

6. The building system according to claim 5, wherein the sealing arrangement is located toward the front side of the panel relative to the plurality of apertures.

7. The building system according to claim 6, wherein the sealing arrangement includes a seal extending along each of the sides of the frame such that corresponding seals of adjacently arranged ones of the plurality of preformed modular panels sealingly engage with one another in the fitted condition.

8. The building system according to claim 1, wherein the opposing sides include a plurality of apertures to allow joining of adjacent one of the plurality of preformed modular panels.

9. The building system according to claim 1, wherein the plurality apertures of the bottom sides are through apertures fittable with a fastener.

10. The building system according to claim 1, wherein the one or more preformed corner panels are generally L-shaped in plan form.

11. The building system according to claim 1, wherein the front sides of the one or more preformed straight panels and one or more preformed corner panels are arranged to fit substantially flush with one another in a fitted condition.

12. The building system according to claim 1, wherein the bottom sides of each of the one or more preformed straight panels and the one or more preformed corner panels include at least three apertures.

13. The building system according to claim 1, wherein the body includes a bottom side, a top side, an inner side and an outer side, the bottom side including a channel to initially carry the seal and a plurality of apertures, the channel extending lengthwise along the body and the plurality of apertures being located in a spaced apart lengthwise arrangement between the channel and the inner side.

14. The building system according to claim 13, wherein the bottom side includes a lengthwise rib extending from the bottom side to form a corresponding channel in the slab, and wherein the plurality of apertures are located at spaced apart intervals along the lengthwise rib.

15. The building system according to claim 13, wherein the top side includes a plurality of apertures that align with the plurality of apertures of the bottom side to allow a void former to be inserted therethrough so as to form voids that align with apertures of panels of the panel system.

16. A method of building using a panel system and an associated formwork system arranged to fit with one another in a predetermined regular grid arrangement, the method including the steps of:

selecting a plurality of preformed panels of the panel system including one or more preformed straight panels and one or more performed corner panels that each include one or more apertures arranged to coincide with the predetermined regular grid arrangement, wherein one or more of the preformed panels includes a sealing arrangement having at least one seal extended along a bottom side;

selecting a plurality of preformed formwork members of the formwork system that are associated with each of the plurality of preformed panels, each of the plurality of formwork members including one or more void formers arranged to coincide with the one or more apertures, wherein one or more of the formwork members is fitted with a releasable seal;

locating the plurality of formwork members such that a slab having a rebate is formable about the formwork members, the slab being formed with one or more slab apertures in the rebate associated with each of the formwork members and the slab retaining the releasable seal of the one or more formwork members for alignment with the seal of the one or more preformed panels;

removing the plurality of formwork members from the slab in a cured condition, locating the plurality of panels atop the rebate of the slab, the plurality of preformed panels being arranged such the abutting sides of adjacent ones of the one or more preformed straight panels and one or more performed corner panels coincide with the predetermined regular grid arrangement without in situ modification and the one or more apertures align with the one or more slab apertures; and fitting one or more fasteners between the one or more apertures and the associated one or more slab apertures thereby coupling the plurality of panels to the slab.

* * * * *